US005737900A

United States Patent [19]

Konstantin et al.

[11] Patent Number: 5,737,900

[45] Date of Patent: Apr. 14, 1998

[54] BANDING METHOD AND APPARATUS WITH ACCELERATION OF BAND ALONG FLOATING MANDREL AIMED TOWARD ARTICLE TO BE BANDED

[75] Inventors: Anatole E. Konstantin, Norwalk; Jaroslaw T. Malkowski, Trumbull, both of Conn.

[73] Assignee: PDC International Corporation, Norwalk, Conn.

[21] Appl. No.: 529,017

[22] Filed: Sep. 15, 1995

[51] Int. Cl.[6] ..... B56B 7/28

[52] U.S. Cl. ..... 53/295; 53/296; 53/585

[58] Field of Search ..... 53/556, 557, 575, 53/585, 291, 295, 297, 298, 399, 296

[56] References Cited

U.S. PATENT DOCUMENTS

| | | | |
|---|---|---|---|
| 2,962,843 | 12/1960 | Hoelzer | 53/563 |
| 3,738,210 | 6/1973 | Fujio | 53/291 |
| 3,889,453 | 6/1975 | Hirai | 53/390 |
| 3,924,387 | 12/1975 | Konstantin | 53/291 |
| 3,974,628 | 8/1976 | Konstantin | 53/291 |
| 4,016,704 | 4/1977 | Fujio | 53/585 |
| 4,170,097 | 10/1979 | Floet et al. | 53/567 |
| 4,208,857 | 6/1980 | Fujio | 53/585 |
| 4,388,797 | 6/1983 | Shields | 53/585 |
| 4,497,156 | 2/1985 | Scheidegger | 53/399 |
| 4,545,181 | 10/1985 | Frankefort | 53/459 |
| 4,600,371 | 7/1986 | Fresnel | 425/110 |
| 4,744,206 | 5/1988 | Winter | 53/295 |
| 4,765,121 | 8/1988 | Konstantin et al. | 53/585 |
| 4,922,683 | 5/1990 | Connolly | 53/291 |

FOREIGN PATENT DOCUMENTS

| | | | |
|---|---|---|---|
| 1561973 | 3/1980 | United Kingdom | B65B 9/14 |

*Primary Examiner*—Daniel Moon
*Assistant Examiner*—John Paradiso
*Attorney, Agent, or Firm*—G. Kendall Parmelee; Parmelee & Bollinger, LLP

[57] ABSTRACT

Banding apparatus in various embodiments include accelerator members for accelerating plastic bands downstream along a floating mandrel for propelling them at high speed with significant kinetic energy in being ejected off from an end of the mandrel toward and around articles to be banded. In one apparatus belts accelerate elongated label bands to more than 1,000 feet per minute. The peripheries of tear-off rollers turn continuously at a first speed for tearing successive bands off from perforated plastic tubing which may be pre-perforated label tubing. Alternatively, plastic tubing may be perforated during operation by continuously feeding flattened tubing between perforator and anvil rollers positioned upstream from the mandrel. Accelerator members shown as rollers or as revolving belts have repetitive first and second peripheral speeds alternating with each other in cycles. The first speed matches peripheral speed of the tear-off rollers during a portion of each cycle when both the tear-off rollers and the accelerator members are engaging a band. The second speed is suitably higher than the first speed for propelling bands downstream at high speed along the mandrel, for example being at least 2.2 times faster in one embodiment and at least 3.7 times faster in another. In a different embodiment, elongated pusher elements on four belts project into four longitudinal channels in a mandrel for pushing bands downstream at high speed along the mandrel and then ejecting them from the mandrel with a final acceleration kick.

40 Claims, 13 Drawing Sheets

198
158C
196
200
158A
200'
2
164
22
190
178
2'
158B
194
2'
26
24A
27
P
192
174
58
58
57
56
57
56
113
166
B
C
60
60
50
59
66
164
62
122
178
63
64
158
64
63
29
184
74
74
176
174
1OD
1OD
74
180
180
79
79
78
188
188
78
82
78
180
P

BANDING METHOD AND APPARATUS WITH ACCELERATION OF BAND ALONG FLOATING MANDREL AIMED TOWARD ARTICLE TO BE BANDED

FIELD OF THE INVENTION

The invention relates to method and apparatus for placing bands around articles to be banded and more particularly relates to such method and apparatus wherein bands are torn off from continuous tubing along predetermined perforated tear lines, and the individual bands are accelerated along and ejected from a floating mandrel aimed toward the articles to be banded.

BACKGROUND OF THE INVENTION

The use of banding with shrinkable plastic film is well known for sealing articles such as bottles, jars, containers, cabs, tubs and the like in an effort to make the article tamper-proof, or at least tamper-evident. Such articles may be filed with medicine, foodstuff, drink, toiletries, and similar products. Plastic bands also may be used for labelling, as well as for packaging purposes, e.g., to fasten two or more articles together or to hold coupons, informational cards, pamphlets or the like against an outer surface of an article in position for subsequent convenient removal and use by a purchaser.

In a packaging operation for efficient product handling it is desirable that banding of articles be sufficiently rapid to keep up with the rate at which the articles are travelling along a production line. Moreover, increased sophistication of production equipment and computer-enhanced controls are enabling production lines to run at higher speeds than usually were attainable in previous years. These requirements of efficiency and higher speeds make it desirable to have banding machines capable of high speed operation using thin, plastic tubing and of separating bands from the tubing and placing the resulting bands around the articles, to be banded in a rapid, accurate and dependable manner.

U.S. Pat. No. 4,497,156—Scheidegger issued Feb. 5, 1985, shows a machine in which a flattened tubular sheath is drawn intermittently from a reel by a pair of counterrotating feed rollers and is cut into clippings of predetermined length. Prior to cutting clippings from the intermittently drawn sheath in the Scheidegger machine, the sheath which has been flat with original creases in a first longitudinal plane is re-flattened and re-creased in another longitudinal plane $P_o$ perpendicular to the first plane to produce a sheath with two substantially flat sides bearing traces of the original pair of creases while being bounded by the second pair of creases. Each of a pair of spaced, parallel guide members has a V-groove facing the V-groove in the opposite guide member. The second pair of creases in the clippings resulting from re-creasing the sheath wall are in plane $P_o$ and are moved along these V-grooves. These V-grooves are shaped so as to converge the second pair of creases toward each other for progressively deforming each clipping so that its sides containing the original creases separate from each other under pressure exerted by the converging V-grooves acting against the second pair of creases. The original creases or fold lines begin to reappear and diverge concurrently with convergence of the second pair of creases. In summary, the re-creased wall of each clipping is substantially flat in plane $P_o$ when first engaged by the V-grooved guide members. Then, the clipping becomes progressively deformed by the V-grooves into a substantially square leading end with a generally rhomboidal trailing end.

This converging V-groove arrangement requires that the re-creased wall of clippings be relatively thick and stiff with resiliency so as to retain traces of the original pair of creases and so as to resist crumpling or collapsing of the clippings while their two sides are moving apart under pressure being exerted by the converging V-grooves and so as to resist crumpling or collapsing under driving force exerted by two belt flights both located on the same side of plane $P_o$ and thus both engaging against a rear edge of the same half of a rhomboidal trailing end of a clipping, thereby being an unbalanced or non-symmetrical pushing engagement against the rhomboidal trailing end of the clipping. To provide the requisite thickness, stiffness and resiliency for such clippings it has been usual practice in a converging V-groove machine as shown in this Scheidegger patent to use a plastic sheath whose wall has a thickness of at least about 0.004 of an inch. Such relatively thick sheath wall consumes a considerable amount of the shrinkable plastic with attendant considerable cost.

SUMMARY

It is among the advantages resulting from employing the method and apparatus embodying the present invention that a high-speed dependable banding is achieved wherein the bands are torn off from plastic tubing along predetermined tear lines defined by spaced rows of perforations in the tubing wall, wherein the tubing wall is enabled to be film-like in thickness for example being only about 0.002 of an inch in thickness, thereby conserving plastic and saving cost relative to the prior sheath wall thickness of about 0.004 of an inch and wherein the resulting torn-off film-like bands are accelerated for becoming propelled at high speed along and then ejected from a floating mandrel aimed toward the articles to be banded.

Moreover, by virtue of this high-speed acceleration the ejected bands are enabled to be propelled relatively far down around the outside of elongated articles without needing much dwell time for each article in a banding station. Also, label bands having relatively long tubular lengths can be accelerated for their resulting kinetic energy to propel the bands down to positions near the bottom of articles without needing much dwell time for each article in the banding station.

In accordance with the present invention as shown embodied in a machine wherein articles to be banded are conveyed through a banding station, the individual bands are provided by tearing them off, one-by-one, from the end of elongated plastic tubing having transverse perforated tear lines located at predetermined intervals uniformly spaced at lengths L along the tubing. The perforated tubing is flat, and it is fed downwardly around a floating mandrel which opens the perforated tubing and keeps the tubing open. Feed rollers provide feed action to move the perforated tubing down around the mandrel. Continuously rotating tear-off rollers are positioned a predetermined distance downstream from the feed rollers. This predetermined distance is less than 2L. These continuously rotating tear-off rollers pull downwardly on the lower end of the perforated plastic tubing, thereby tearing off successive bands moving downstream along the mandrel.

In one embodiment of the invention, feeding of the perforated tubing is continuous, and tear-off motion is faster than feed action, thereby providing acceleration for tearing off successive lengths L of the tubing at transverse perforated tear lines for forming successive bands moving at high speed downstream along the mandrel. In this example of the invention, four continuously revolving endless belts are located at substantially symmetrically spaced positions around the mandrel. These belts have elongated projecting pusher elements at equispaced locations along the belts. In operation, four of these pusher elements are arranged simultaneously to push downwardly against four regions of an upper edge of each band as the pusher elements simultaneously enter into and travel downstream along four longitudinal channels provided in the mandrel. Thus, these pusher elements propel each band downwardly at high speed along the mandrel. The four channels are substantially symmetrically spaced around the circumference of a circular cylindrical lower portion of the mandrel. Advantageously, such pusher elements simultaneously engage four substantially uniformly spaced regions, i.e., regions in four different quadrants, of an upper edge of each circular band for substantially uniformly distributing stress around the circumference of the upper edge of each band for minimizing distortion of a film-like band as it is being pushed downwardly at high speed along the mandrel. The pusher elements eject each band off from a lower end of the mandrel aimed at each article to be banded. During ejection of each band from the mandrel, the outer ends of the four elongated pusher elements now are revolving around an axis and so they are effectively moving faster than the belt for imparting a final kick to the ejected band in a second acceleration to increase or maintain kinetic energy of the band aimed at the article to be banded.

In the banding machine shown as one embodiment of the invention, the flattened plastic tubing is being continuously fed and is being perforated near an upstream end of a floating mandrel. This machine also may handle plastic tubing which is preperforated.

In other embodiments of the invention as shown, perforated plastic tubing is fed with intermittent motion. Tear-off rollers are continuously rotating. Downstream from the continuously-rotating tear-off rollers are continuously-turning acceleration push-off members shown as rollers in one embodiment or belts in another embodiment. These continuously-turning acceleration push-off members have a first peripheral speed matching the peripheral speed of the continuously-rotating tear-off rollers and a second higher peripheral speed which is more than two times or more than three times the peripheral speed of the tear-off rollers. The higher peripheral speed occurs after the bands have left the tear-off rollers and accelerates the bands to high speed travelling along the mandrel and ejecting them from the end of the mandrel aimed at articles to be banded. Thus, dwell time of articles in a banding station is minimized, or the articles may be continuously conveyed through the banding station relatively rapidly for achieving a high production rate. Also, kinetic energy of high-speed ejected bands propels them substantially down the full length of tall articles for the bands to be applied as encircling sleeve labels.

As used throughout the specification and claims, the term "article" is intended to mean one or more articles to be banded either separately or together, and also is intended to mean any suitable container, e.g., a bottle, jar, can, etc. to be sealed, banded or labelled.

As used herein the term "mandrel" is intended to mean a device that fits inside plastic tubing, serving to open and to keep the tubing open and internally supporting the plastic tubing, thereby causing it to be conformed generally to the shape of the mandrel. The size of the mandrel is preferably slightly smaller than the inside of the tubing and it has a smooth surface over which the tubing can slide easily. The mandrel also provides surfaces and internal rollers against which the tube feeding means, the tear-off means and the band acceleration means exert pressure in order to perform their respective functions. Also, the mandrel supports the relatively thin film-like bands for preventing them from crumpling or collapsing as they are accelerated and propelled at high speed along the mandrel for ejecting them toward the respective articles being banded.

As used herein the terms "up", "upwardly", "down", "downwardly", "vertical" and "vertically", "horizontal" and "horizontally" and the like are used for convenience of description with reference to the drawings and are not being used in a limiting sense, because the operating components of the machine are on a chassis which is adjustable in position as indicated in FIG. 1 so that the components described by these convenient terms may or may not be oriented or movable in true vertical or horizontal directions, wherein true vertical is perpendicular to a horizontal plane on the Earth.

BRIEF DESCRIPTION OF THE DRAWINGS

The invention, together with further objects, features, advantages and aspects thereof, will be more clearly understood from the following detailed description considered in conjunction with the accompanying drawings illustrating the principles of the invention. Like reference numerals indicate like elements or like components throughout the different views.

The accompanying drawings, which are incorporated in and constitute a part of the specification, illustrate presently preferred embodiments of the invention and, together with the general description set forth above and the detailed description set forth below, serve to explain the principles of the invention. In these drawings:

FIG. 4 is a view as seen from the plane 4—4 in FIG. 1.

FIG. 5 shows combined suspension and continuously rotating feeding rollers, higher-speed continuously rotating tear-off rollers, and continuously revolving band-propelling push-off belts.

FIG. 7 shows the higher-speed continuously rotating tear-off rollers and the continuously revolving band-propelling push-off belts.

FIG. 8A-1, 8A-2 and 8A-3 show plots of rotational rates of the three tiers of rollers in FIG. 8 plotted for one cycle of operation from 0° to 360°. Upper rollers are run and stop feed rollers; middle rollers are continuously turning tear-off rollers; and lower rollers are acceleration and push-off rollers.

DETAILED DESCRIPTION

Figure 1:
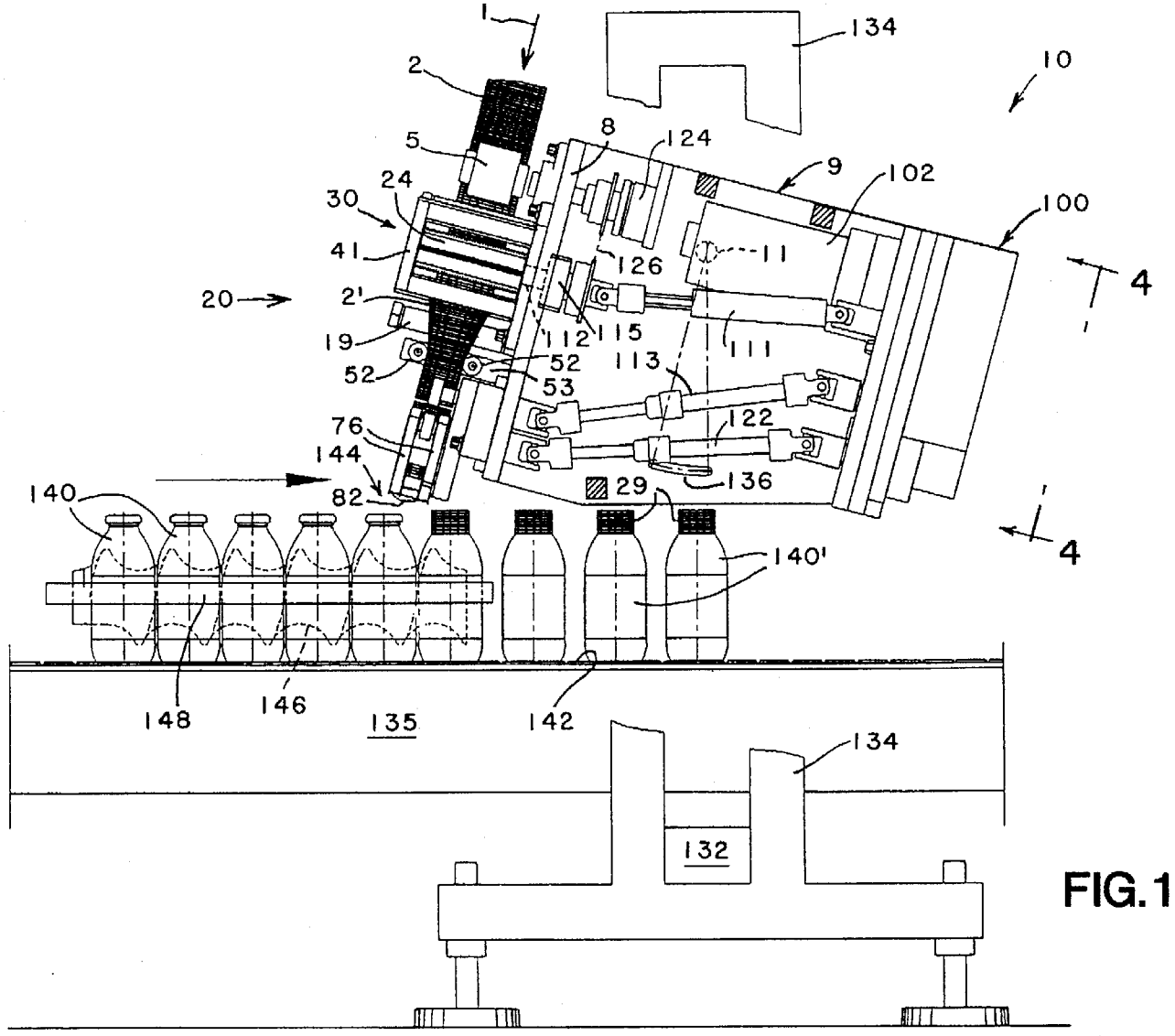
FIG. 1 is a side elevational view of a machine in accordance with method and apparatus embodying the invention.
Figure 2:
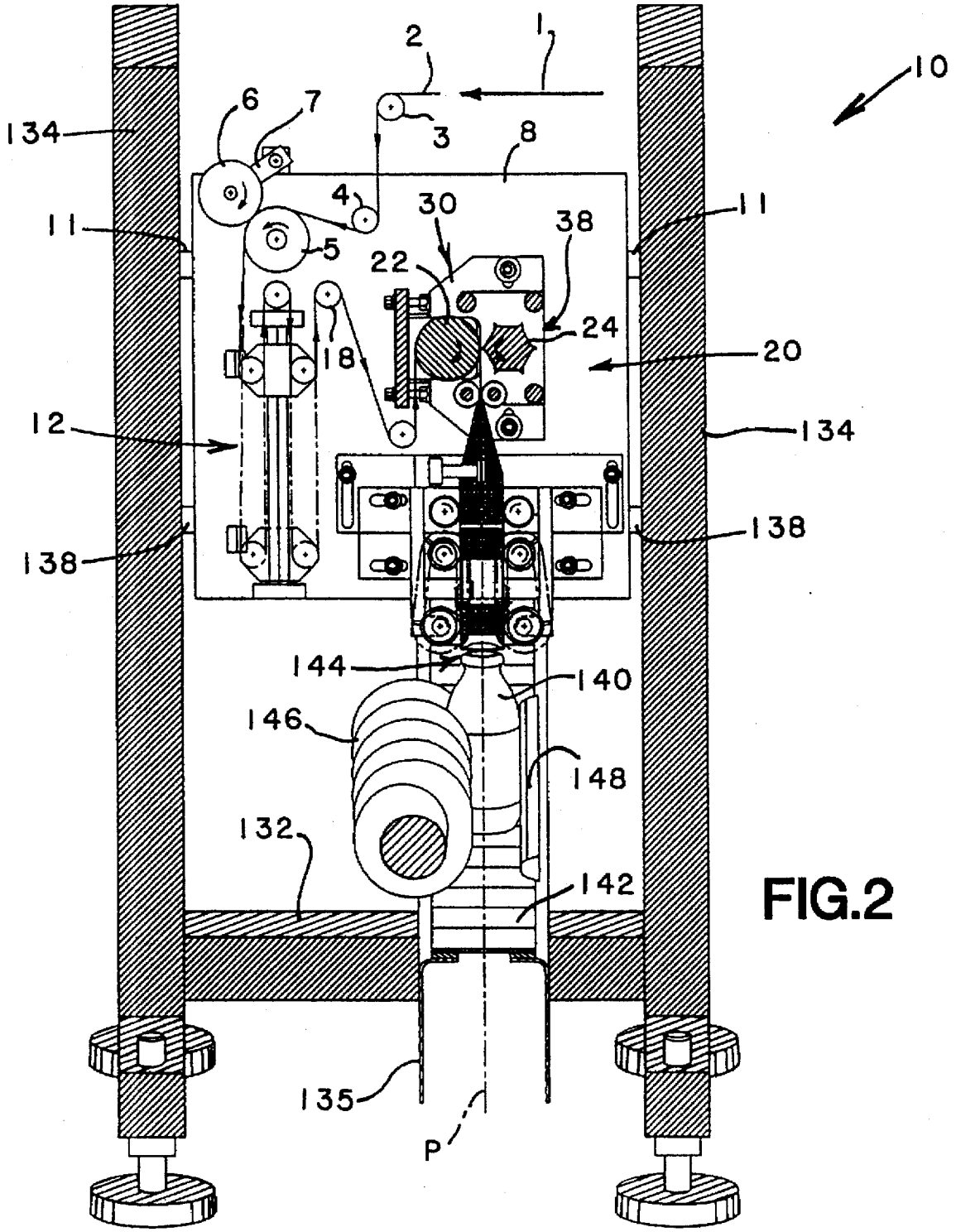
FIG. 2 is a front end elevational view of the machine of FIG. 1 as seen looking downwardly toward the input end.

In order to gain a better understanding of the apparatus and method of the present invention, reference is made to the drawings. FIGS. 1 and 2 illustrate a machine generally indicated at 10 in which flattened plastic tubing 2 is fed from a suitable supply source as indicated by an arrow 1, for example a supply source such as a coil or reel. The tubing passes guide rollers 3 and 4 and a driven feed-roller 5 having an opposed hold-down roller 6 carried by an arm 7 pivotally mounted on a front plate 8 forming part of an adjustable chassis 9 (FIG. 1) to be described later. This chassis 9 is angularly adjustable about pivots 11 (FIGS. 1 and 2).

For providing isolation between the tubing supply source 1 and banding apparatus 20 mounted on plate 8, the flat tubing 2 is shown threaded through a buffer station 12 mounted on the front plate 8. The tubing is festooned through this buffer station by running over an upper roller 14 (FIG. 3) fixed in position and under two lower rollers 15 carried by a carriage 16 freely movable up and down along fixed vertical guide rods 17. This carriage is movable between an upper position shown in full lines and a lower position shown in dashed and dotted lines with reference numbers 2', 15' and 16' (FIG. 3).

Figure 3:
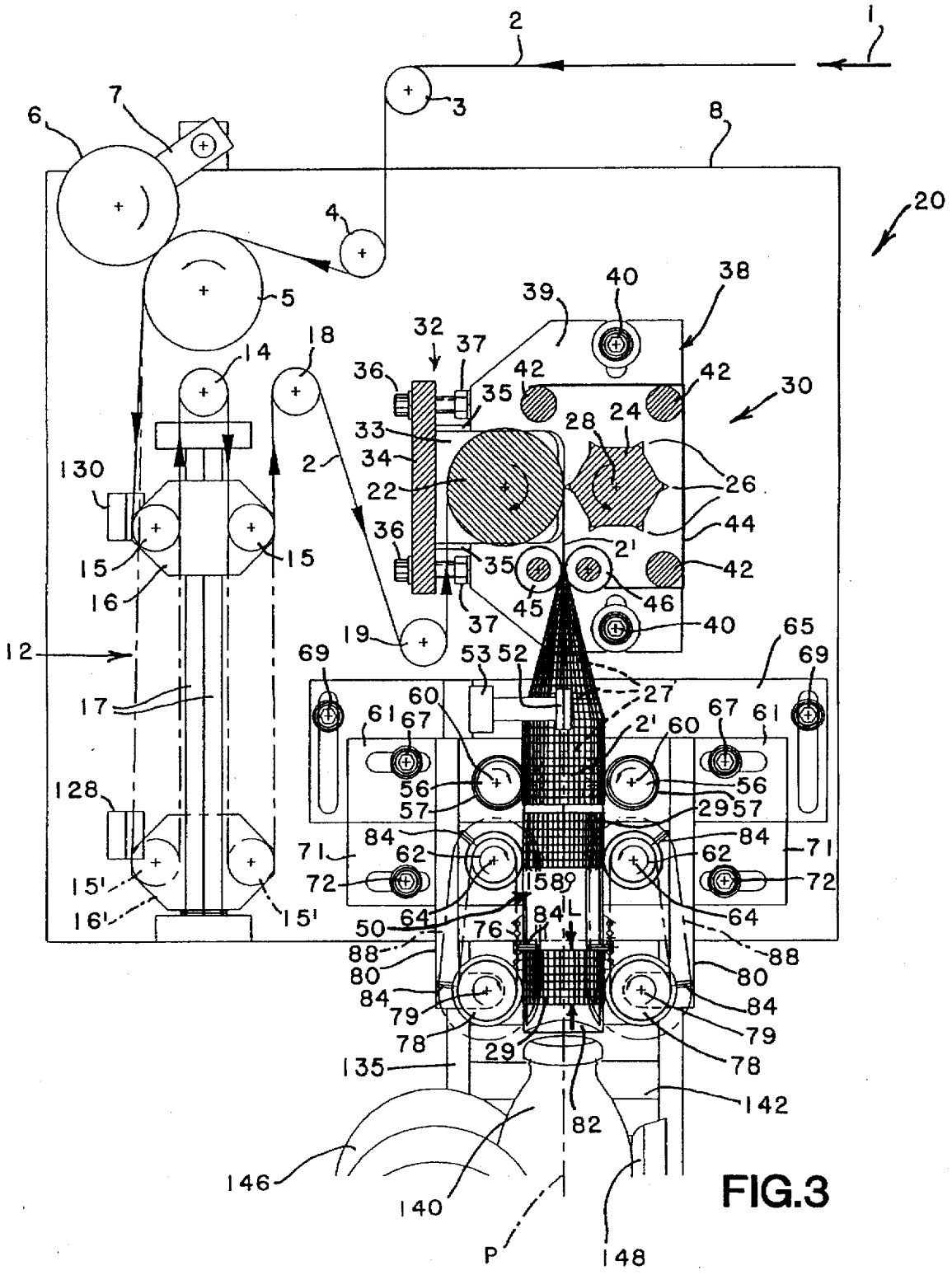
FIG. 3 is an enlargement of the banding method and apparatus shown in FIG. 2.

Following the buffer station 12 the flag tubing 2 is shown in FIG. 3 passing guide rollers 18 and 19 and entering a perforator 30 included in the banding apparatus 20. The tubing is shown running up from roller 19 and half-way around an anvil roller 22 having a smooth surface formed of suitable, hard, durable material, for example being made of tool steel. The flat tubing 2 runs down between this anvil roller 22 and a driven, perforator rotor 24. This rotor 24 carries several peripherally equispaced perforator blades 26 (six in the present instance) which extend parallel to the axis 28 of rotor 24. Each blade 26 includes numerous small sharp teeth with small spaces between the teeth. These blades 26 perforate the tubing wall with numerous small perforations defining transverse tear-off lines 27 (FIG. 3) extending perpendicular to the length of the tubing and being equispaced along the tubing. The spacing along the tubing between successive tear-off lines 27 (FIG. 3) and thus the axial length L (FIG. 3) of the resultant bands 29 depends upon diameter of rotor 24 and number of its blades 26. The rotor 24 can be replaced by one of larger or smaller diameter and having fewer or more blades 26 for changing spacing between tear-off lines 27 and thus changing resulting band length L. It is preferred that anvil roller 22 be rotationally driven, as explained later. The perforator rotor 24 is driven, as explained later, so that peripheral speed of tips of its perforator blades 26 nearly matches but is very slightly slower than travelling speed of tubing 2 provided by continuously-turning tubing-feed rollers located downstream of the perforator, as described later.

Anvil-roller position-adjustment means 32 are shown for precisely positioning the cylindrical surface of anvil roller 24 relative to sharp tips of teeth on blades 26 so these teeth tips fully perforate both thicknesses of the flattened wall of tubing 2 and just barely touch the smooth, hard surface of the anvil roller. For example, position-adjustment means 32 are shown including an adjustable mount 34 carrying anvil roller 22 and having a plurality of adjusting screws 36 each threaded into a perforator chassis 38 and held in their precision-adjusted positions by suitable locknuts 37 with lockwashers seated against the perforator chassis. The adjustable mount 34 includes a pair of sides 33 (only one is seen in FIG. 3) each having a pair of parallel edge rims 35 slidable along grooves in wall members 39 of perforator chassis 38. (Only one wall member 39 is seen in FIG. 3.)

The perforator 30 is adjustable in position up or down along chassis plate 8 by means of adjusting screws 40 received in slots in the wall member 39 for enabling floating mandrels of various lengths to be installed in the banding apparatus. Another wall member 41 (FIG. 1) of perforator chassis 38 is supported parallel to wall member 39 by a plurality of stand-off posts 42 (FIG. 3). Unintended access to perforator rotor 24 is prevented by a removable shield 44 extending around the perforator adjacent to posts 42.

As will be understood from FIG. 1, the axial lengths of anvil roller 22 and perforator rotor 24 may be considerably greater than the width of flat tubing 2 for enabling handling of flat tubing of considerably greater width than shown for providing bands of larger diameter when desired.

Immediately after being perforated, the flat tubing is withdrawn tangentially from the surface of anvil roller 22 and travels downwardly in a plane P between a pair of closely-spaced, opposed, freely-rotating guide rollers 45, 46 (FIG. 3) mounted on perforator chassis 38.

The axes of these guide rollers are parallel with the plane P of the downwardly travelling flat tubing and also parallel with a ridge 47 (FIGS. 5, 6 and 7) which extends across the top of a wedge-shaped upper end 51 of a floating mandrel 50. The axial lengths of these two guide rollers 45, 46 is greater than the width of the perforated flat tube 2' (FIG. 3) approaching ridge 47 for enabling handling flat tubing of considerably wider width, if desired, as explained regarding width of the perforator. These guide rollers assure that both sides of the perforated flat tube are smooth and are lying close to the plane P (FIGS. 2, 3 and 5) with which is aligned the ridge 47.

Figure 5:
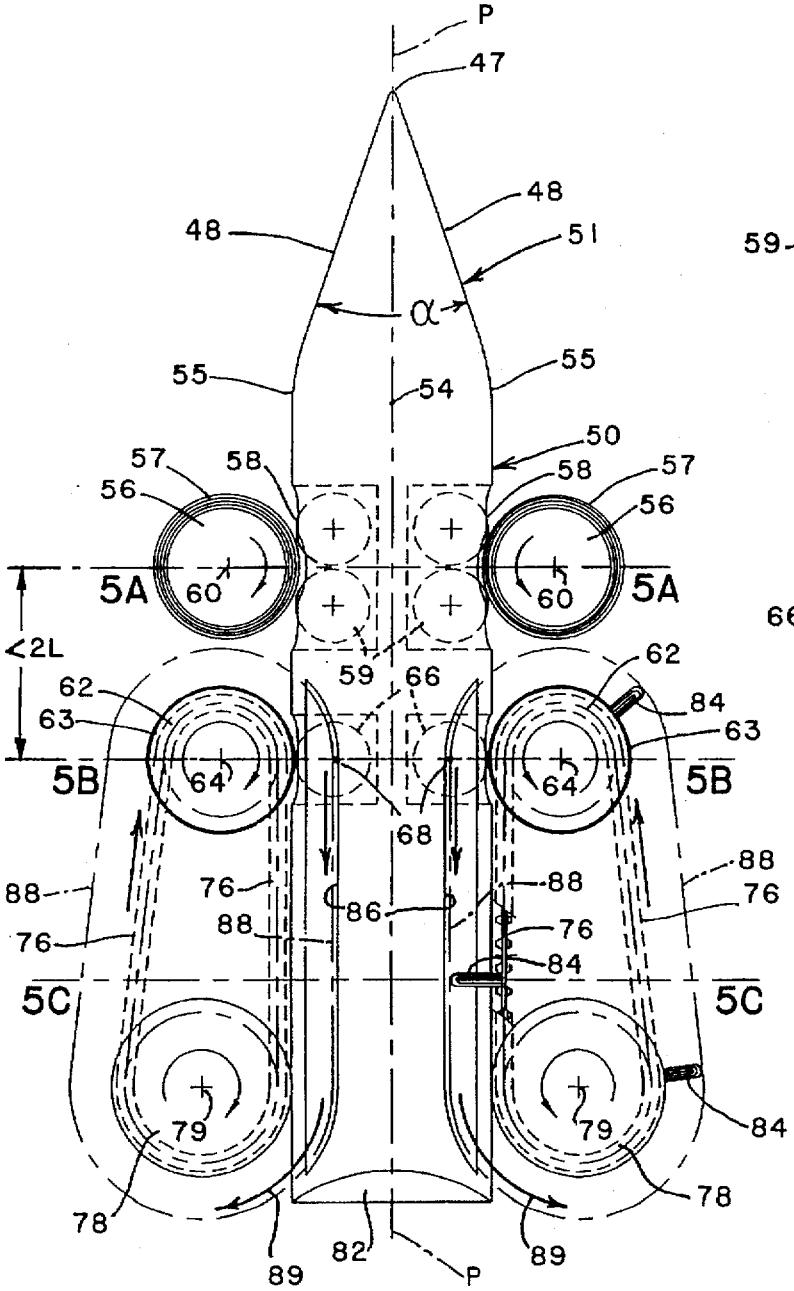
FIG. 5 is an enlarged front elevational view of the floating mandrel corresponding with its showing in FIGS. 2 and 3 omitting the plastic tube of banding material and omitting the torn-off bands for clarity of illustration.
Figure 5A:
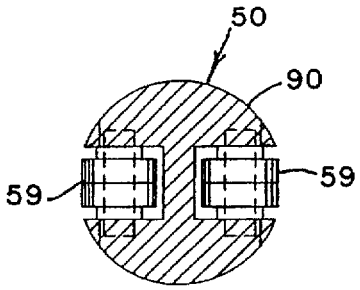
FIGS. 5A, 5B and 5C are sectional views taken through the mandrel along planes 5A, 5B and 5C in FIG. 5 as seen looking downwardly from these planes.
Figure 5B:
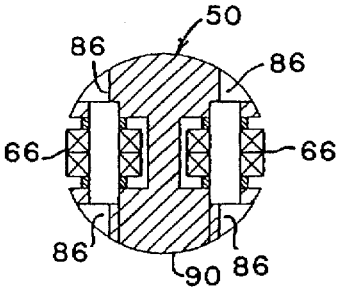
Figure 6:
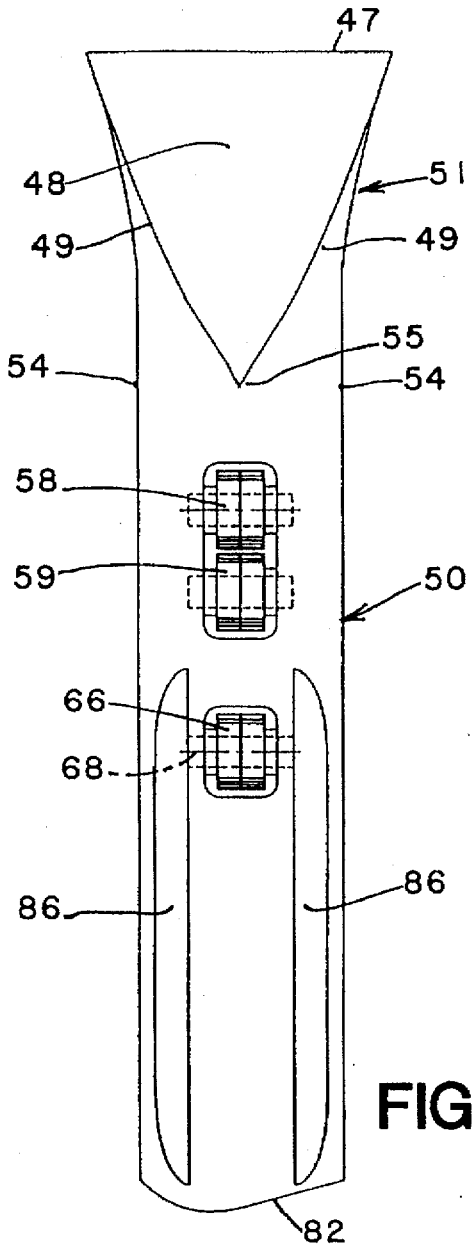
FIG. 6 is a side elevational view of the floating mandrel as seen looking from the right in FIG. 5, showing the same side of the mandrel as in FIG. 1.
Figure 6A:
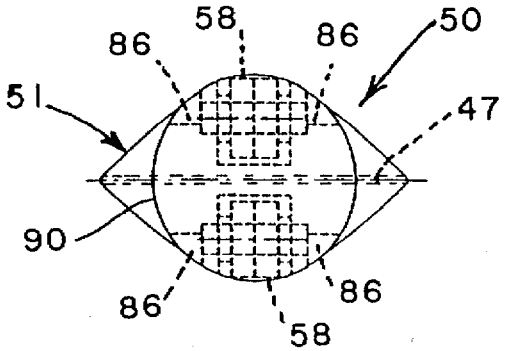
FIG. 6A is a bottom view of the floating mandrel in the orientation of FIG. 6.
Figure 7:
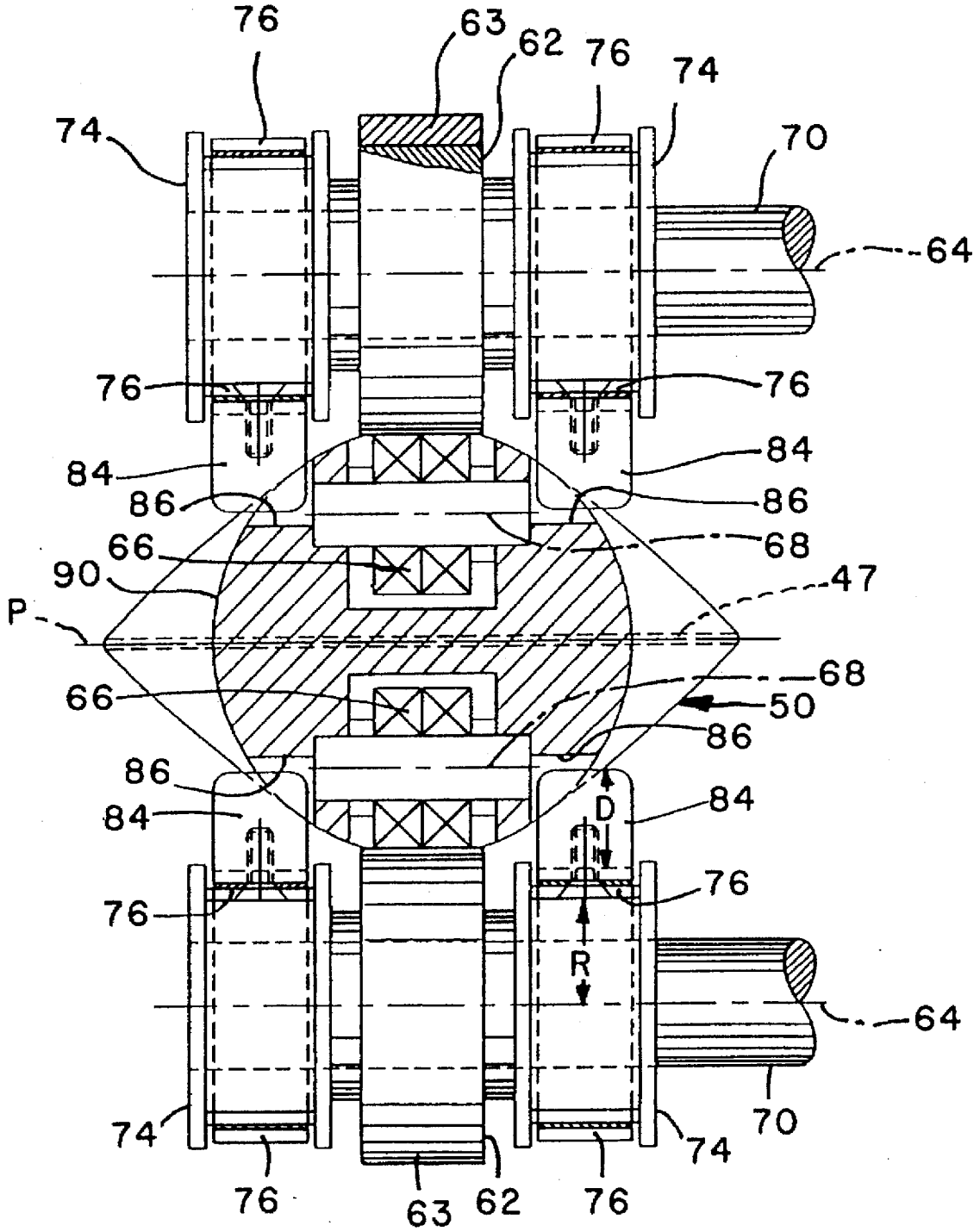
FIG. 7 is a further enlarged sectional view of the mandrel taken generally along the plane 5B—5B in FIG. 5 as seen looking upwardly, with mandrel orientation corresponding with FIG. 6.

As shown in FIGS. 5, 6 and 7, the floating mandrel 50 is coated with or formed of any suitable slippery metal or slippery plastic material, for example such as Teflon polytetrafluoroethylene (PTFE) and the like, over which the plastic film-like perforated tubing 2' (FIG. 3) will slide easily. The ridge 47 and triangular wedges 48 (only one is seen in FIG. 6) of a tapered upper transition end 51 of the mandrel smoothly open the perforated tubing 2' at relatively high speed as it slides down around the mandrel. This ridge 47 and wedges 48 are shaped to provide a smooth transition of the perforated tube 2' from flat to circular cylindrical configuration. Thus, the tapered upper end 51 of mandrel 50 is preferred to be shaped to provide a constant distance around its periphery at each successive position downwardly along the wedge 48. This constant peripheral distance is desirably closely matched with (but is sufficiently less than) the circumferential distance around the inner wall surface of the perforated tubing 2' for supporting the tubing while allowing free sliding of the tubing downwardly around the mandrel.

Figure 5C:
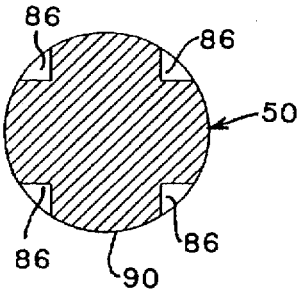

The plane P extending longitudinally along mandrel centerline 51 (as seen most clearly in FIGS. 5 and 5C) is the plane of the perforated flat tubing 2' (FIG. 3) travelling downwardly from the perforator 30. As explained above, ridge 47 lies in plane. P. Only one generally triangular wedge face 48 is seen in FIG. 6 of two triangular faces. This wedge face 48 is generally isosceles triangular in configuration with two slightly convex edges 49 meeting at a vertex 55 as seen in FIG. 6 looking in a direction perpendicular to plane P. As shown in FIG. 5, looking in a direction along plane P, the two triangular faces 48 diverge symmetrically from the plane P in a downstream direction with an included angle $\alpha$ in a range of about 35° to about 40°.

As seen in FIG. 1, the opened perforated tubing is fed down around the mandrel between a set of freely-rotatable mandrel-positioning and stabilizing rollers 52 mounted on opposite sides of the mandrel by a bracket 53. Only one of these mandrel-positioning and stabilizing rollers 52 is seen in FIGS. 2 and 3. Each of these rollers has an opposed, freely-rotatable companion roller mounted inside of the mandrel for providing aligned rolling contact against inner and outer wall surfaces of the perforated tubing 2'. These rollers 52 are centered on the plane P and are shown located at rolling contact positions 54 at a vertical level on the mandrel generally aligned with the vertical level of vertices 55 of the isosceles triangular wedge-faces. Thus, these rolling contact positions 54 are shown located near a level of the vertices 55 at downstream ends of triangular wedge faces 48 and at an upstream end of a circular cylindrical peripheral shape 90 (FIGS. 5A, 5B, 5C, 6A and 7) of the mandrel.

Below the mandrel-positioning and stabilizing rollers 52, the perforated tubing 2' is shown being fed down around the mandrel 50 by a pair of continuously rotating feed rollers 56 located on opposite sides of plane P. These feed rollers 56 have rims 57 of suitable high friction material frictionally gripping the perforated tubing 2', for example such as polyurethane and the like, or the entire feed roller may be formed of such material. Feed rollers 56 press the perforated tubing wall inwardly slightly as will be appreciated from FIG. 5 into rolling contact with respective sets of freely rotatable upper and lower suspension rollers 58, 59 mounted inside of mandrel 50 and spaced equal distances above and below the transverse plane 5A—5A (FIG. 5) with axes 60 of feed rollers 56 being in this transverse plane for suspending the floating mandrel. In other words, the two feed rollers 56 in cooperation with their respective sets of suspension rollers 58, 59 serve the dual functions of suspending the mandrel and also of continuously feeding perforated tubing 2' downwardly around the mandrel.

In FIG. 3, the feed rollers 56 are shown having their rotating shafts supported by mounting plates 61 horizontally adjustable on a second adjustable mounting plate 65 by machine screws 67 engaging in horizontal slots, thereby enabling adjustment of lateral spacing between the feed rollers 56 for accommodating floating mandrels of various diameters for handling tubing and bands of various diameters. The second mounting plate 65 is adjustable in vertical position on the front plate 8 by machine screws 69 engaging in vertical slots, thereby enabling adjustment of vertical spacing between feed rollers 56 and the tear-off rollers 62, which are described below, for handling bands 29 of various lengths L. The suspension rollers 58, 59 in the mandrel are vertically positioned to be in suitable cooperative relationship as shown in FIG. 5 with respect to the vertical position of the feed rollers 56. One way for providing suitable cooperative relationship between suspension rollers 58, 59 and vertically repositioned feed rollers 56 is to provide means in the mandrel 50 for adjusting vertical positioning of these suspension rollers relative to the mandrel itself. Another way for providing suitable cooperative relationship between suspension rollers 58, 59 and vertically repositioned feed rollers 56 is to remove the mandrel and replace it with another mandrel in which the suspension rollers 58, 59 are appropriately vertically positioned relative to the feed rollers.

Below the continuously rotating feed rollers 56, the perforated tubing 2' is engaged by a pair of continuously rotating tear-off rollers 62 located on opposite sides of plane P with axes 64 in the transverse plane B—B. These tear-off rollers have rims 63 (FIG. 5) of suitable high friction material similar to material in rims 57 of the continuous feed rollers. Peripheral speed of tear-off rollers 62 as shown is more than three times peripheral speed of feed rollers 56, thereby accelerating the resulting torn-off bands to a velocity more than three times the continuous feed rate of perforated tube 2'. Each of these tear-off rollers has an opposed, freely-rotatable companion roller 66 mounted inside of the mandrel with axes 68 in transverse plane B—B for providing aligned rolling contact against inner and outer surfaces of the perforated tubing 2'.

As shown in FIG. 7, the continuously turning tear-off rollers 62 are mounted on and are keyed to a pair of drive shafts 70 having respective axes 64. These shafts 70 are supported by mounting plates 71 (FIG. 3) horizontally adjustable on front plate 8 of machine chassis 9 (FIG. 1) by machine screws 72 engaging in slots for accommodating installation of floating mandrels of various diameters for handling tubing and bands of various diameters.

Two flanged, belt-drive, toothed pulleys 74 are mounted on and are keyed to each of the shafts 70 with a tear-off roller 62 between them. An endless toothed belt 76 (FIGS. 3 and 7) is positively driven by each toothed pulley 74 and revolves in an elongated oval path around its drive pulley 74 and around a lower idler pulley 78 mounted by a bracket 80 (FIG. 3) for rotation about an axis 79. Each of the brackets 80 extends down from the mounting plate 71 so that the idler pulleys 78 are positioned on opposite sides of plane P and are located near a lower end 82 of the mandrel 50.

As shown in FIG. 7, there are four belts 76, and each belt has a plurality of outwardly projecting elongated pusher elements 84 secured to the belt at equal spacings along the belt. For example, as shown in FIG. 3 it is preferred to have at least three pusher elements 84 on each belt so at least one of the pusher elements of each belt always is moving along an elongated channel in the mandrel as will be explained. These elongated pusher elements project outwardly from the outer surface of the belt a substantial distance. For example, they project out from the belt by a dimension D (FIG. 7) of more than about 70% of the radius of curvature R of its drive pulley 74.

Each revolving belt 76, in a straight downward portion of its oval path, is travelling downwardly parallel with and close to a lower portion of the mandrel. There are four pusher-clearance channels 86 extending longitudinally in the lower portion of the mandrel. These channels extend parallel with the four respective downwardly travelling belts.

The dash and dotted oval lines 88 (FIGS. 3 and 5) indicate oval paths travelled by the outer ends of the elongated pusher elements 84 as they revolve with their respective belts 76. As these elongated pusher elements swing around their drive pulleys, their outer ends enter into upper end portions of respective clearance channels 86. Thus, four pusher elements simultaneously are propelling a torn-off band 29 downwardly at high speed along the circular cylindrical surface 90 (FIGS. 5C and 7) of the mandrel 50. This mandrel surface advantageously supports the fast-travelling band against collapsing or significantly distorting. Moreover, these four channels 86 are substantially equispaced, as is seen most clearly in FIG. 5C, around the circular cylindrical surface 90 of the lower portion of the mandrel. Thus, as will be appreciated from FIG. 7, the four elongated pusher elements 84 in entering and travelling along these channels 86 are engaging and pushing downwardly against four substantially uniformly spaced regions, i.e., regions in four different quadrants, of an upper edge of each circular band 29 (FIG. 3) for substantially uniformly distributing stress around the circumference of the upper edge for minimizing distortion of the film-like plastic material of bands being pushed downwardly at high speed along the mandrel toward its lower end 82.

As the elongated pusher elements 84 exit from lower ends 87 (FIG. 5) of channels 86 they are swinging (revolving) around the axes 79 of idler pulleys 78 as shown by curved arrows 89. Thus, the outer ends of these swinging pusher elements are moving faster than their belts for imparting a final kick to the ejected band in a final acceleration to increase or maintain kinetic energy of the band 29 being ejected and aimed toward an article to be banded.

Each of the four idler pulleys 78 (FIG. 5) has a radius larger than the radius R of each belt-drive pulley 74 (FIG. 7) for enlarging a radius of swing of the tips of elongated pusher elements 84 in revolving around the idler pulleys relative to a radius of swing of these tips in revolving around the belt-drive pulleys. This enlarged radius of pusher swing prevents the final swinging kick of the elongated pusher elements against the upper edge of each ejected band from applying an undue component of kick motion outward in a direction away from plane P while allowing the downward component of kick motion in a direction parallel with plane P to be significantly effective in the desired downward propulsion direction.

FIG. 3 shows one circular band 29 down near the lower end 82 of the mandrel being propelled downwardly at high speed by pusher elements 84. Another is shown in FIG. 3 having just been torn off by the tear-off rollers 62 from the lower end of the perforated tubing 2' and being accelerated downwardly by these tear-off rollers to a speed which is at least three times the rate of speed imparted to the perforated tubing 2' by continuously turning feed rollers 56. FIG. 3 shows pusher elements 84 swinging around axes 64 in readiness for entering the pusher-clearance channels 86 above the upper edge of this recently torn-off band 29. It is noted that the pusher elements 84 are sufficiently widely spaced along each belt 76 for allowing only one pusher element on each belt to come into contact with each torn-off band 29.

Figure 4:
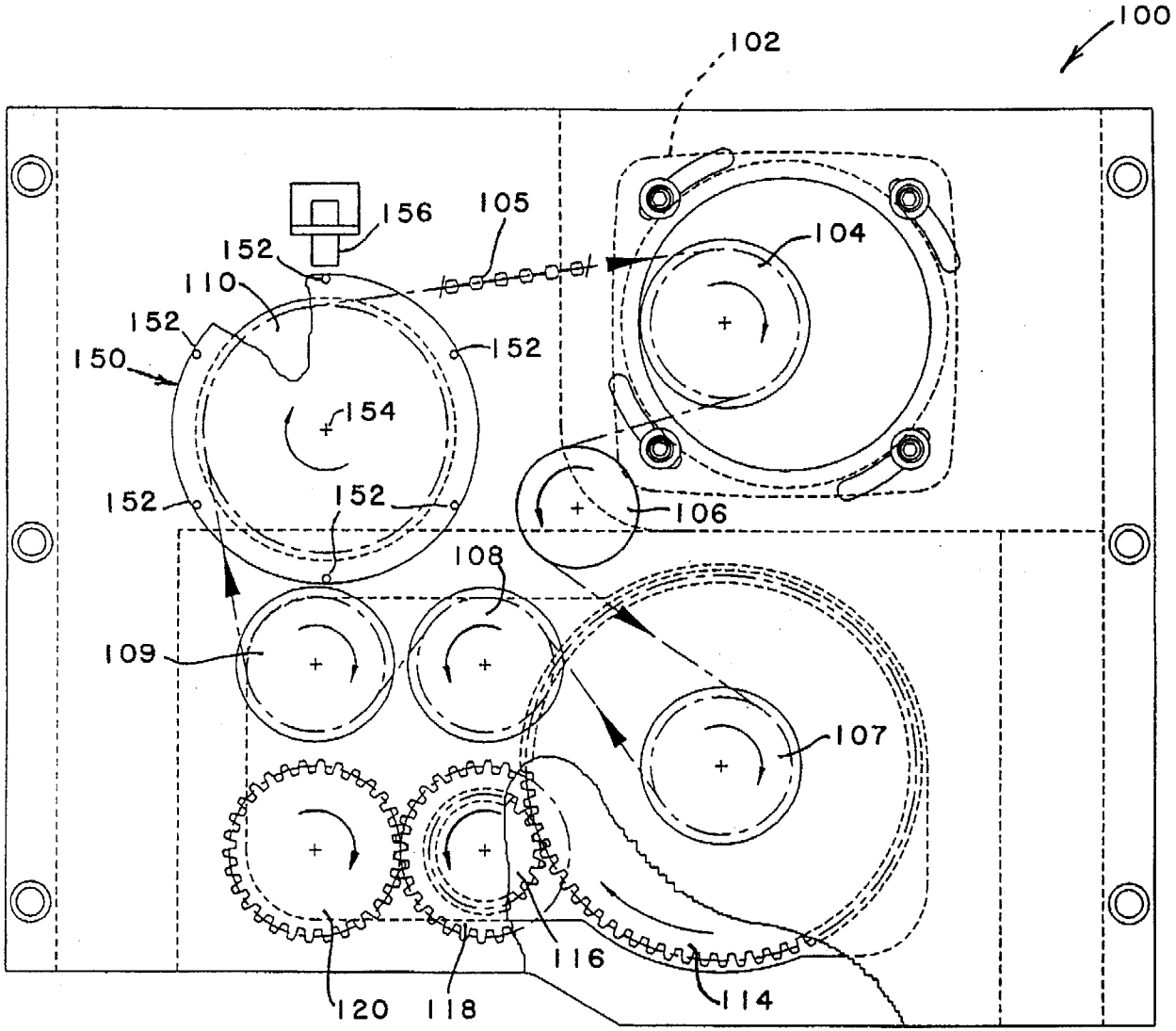
FIG. 4 is an enlargement of a transmission housing and components of the transmission seen in FIG. 1 with the cover removed.

In order to drive feed rollers 56, higher-speed tear-off rollers 62 and belt-drive pulleys 74, drive and transmission means 100 are provided as shown in FIGS. 1 and 4 mounted on adjustable chassis 9. Drive and transmission means 100 are shown including an electric motor 102 turning a toothed belt-drive pulley 104 for running a double-sided toothed belt 105 in sequence around idler pulley 106, and drive pulleys 107, 108, 109 and 110. Drive pulley 110 is connected via drive shaft 111 (FIG. 1) to a perforator-rotor-drive shaft 112 (FIG. 1) on the axis 28 of perforator rotor 24.

For rotationally driving the anvil roller 22 (FIG. 3), a drive disc 115 (FIG. 1) is keyed to the perforator-rotor drive-shaft 112. This drive disc 115 has a rim of high friction material which is in frictionally driving relationship with a similar rim of a driven disc (not shown) which is keyed to the shaft of the anvil roller 22 for rotating it at suitable surface speed.

Drive pulleys 108 and 109 are identical in diameter and rotate in opposite directions, being connected via identical drive shafts 113 (Only one is seen in FIG. 1.) to respective feed rollers 56 (FIG. 3) for turning them in opposite directions at identical peripheral speed around their respective axes 60, as is shown by curved arrows in FIG. 3.

It is desired that the peripheral speed of feed rollers 56 be slightly faster than the peripheral speed of the tips of perforator blades 26 for reasons explained below. To accomplish this slight difference in peripheral speed, the diameter of feed-roller drive pulleys 108, 109 relative to a larger diameter of perforator-rotor drive pulley 110 is suitably selected with reference to a peripheral distance travelled during one revolution by tips of perforator blades 26 and with reference to a smaller peripheral distance travelled during one revolution by rims 57 of feed rollers 56, such that peripheral speed of feed rims 57 is very slightly faster by a speed difference in a range of about 0.03% to about 0.5% than peripheral speed of perforator blade tips. This slight differential in peripheral speeds is designed for keeping the perforated tubing 2' under slight tension for smoothly flowing from the perforator 30 to the feed rollers 56 without significant wrinkling. The resulting slight difference in peripheral speeds may be accommodated by unperforated tubing 2 sliding forwardly slightly upon the smooth surface of anvil roller 22 and may be accommodated by the frictional drive 115 (FIG. 1) of the anvil roller.

Drive pulley 107 rotates a relatively large diameter gear 114 coaxial with pulley 107. This larger gear 114 meshes in driving engagement with a smaller gear 116 for driving another gear 118 coaxial with gear 116. Gear 118 meshes with a companion gear 120 of the same diameter for providing identical counterrotational speeds of gears 118 and 120. Gears 118 and 120 are connected via drive shafts 122 (Only one is seen in FIG. 1.) to respective belt-pulley drive shafts 70 (FIG. 7). for turning shafts 70 in opposite directions at the same speed.

For accommodating up and down adjustment in positioning of perforator 30 for enabling installation of mandrels of various lengths and for accommodating horizontal adjustment of axes 60, 64 and 79 for enabling installation of mandrels of various diameters, the drive shaft 111 and the pairs of drive shafts 113 and 122 (FIG. 1) include universal joints at each end of the respective drive shafts with an intermediate telescoping length-adjusting section in each drive shaft.

It is preferred that the peripheral speed of rims 63 of tear-off rollers 62 be at least about 3 times the peripheral speed of feed rollers 56 for spacing bands 29 along the mandrel by intervening spaces greater than band length L. For example, as shown in FIG. 4, the diameter of pulley 107 may be equal to that of pulleys 108, 109. Then, gear 114 may have a diameter 3.4 times that of gear 116 for turning tear-off rollers 62 at a rotational rate 3.4 times the rate of feed rollers 56. Since the diameter of tear-off-roller rims 63 substantially equals that of feed-roller rims 57, the peripheral speed of the tear-off-roller rims is about 3.4 times faster.

For driving the tubing feed roll 5 (FIGS. 1, 2 and 3) its shaft may be connected through an electromagnetically-actuated clutch 124 (FIG. 1) and via sprocket-and-chain connection 126 to the perforator rotor shaft 112 (FIG. 3). It is desired that peripheral speed of feed roller 5 slightly exceed peripheral speed of perforator blade tips so that perforator 30 always has an adequate supply of incoming tubing 2. To provide this faster peripheral speed, feed roller 5 diameter may be slightly larger as shown in FIG. 3 than blade-tip-to-blade-tip diameter of the perforator rotor.

While the electromagnetic clutch 124 is engaged, the faster tubing feed rate produced by roller 5 relative to tubing usage rate causes tubing 2 to accumulate in the buffer station 12. During such accumulation, the carriage 16 moves down toward its lower position 16' where it triggers a lower position sensor 128 in a control circuit for disengaging the clutch 124. While the clutch 124 is disengaged, tubing withdrawal from buffer station 12 causes carriage 16 to rise up toward its upper position, where it triggers an upper sensor 130 in a control circuit for engaging clutch 124. Thus, the feed roller 5 and buffer station 12 cooperate for providing an appropriate feeding of tubing 2 into the perforator.

As shown in FIG. 2, frame 132 of machine 10 includes a pair of spaced parallel racks 134 with feet for standing the racks on opposite sides of a product conveyor frame 135. The adjustable carriage 9 (FIG. 1) is supported above the product conveyor frame 135 by these racks 134 by a pair of pivots 11 mounted on the two racks. Inclination of carriage 9 is adjusted by use of an arcuate slot 136 on each side of the chassis cooperating with suitable position-locking means 138 (FIG. 2) on the racks engaging in the arcuate slots.

Articles 140 to be banded are carried on a conveyor 142 (FIGS. 1 and 2). A banding station 144 is a position on the conveyor 142 toward which the lower end 82 of the mandrel is aimed. To control positioning of each article relative to the banding station 144 a timing screw 146 cooperates with an opposite guide rail 148. The conveyor 142 moves somewhat faster than the effective article-advancement rate of timing screw 146. Thus, after passing through the banding station 144, banded articles 140' released from the timing screw become uniformly separated one from another as seen in FIG. 1.

In order to control a product handling drive (not shown) turning timing screw 146, there is a synchronizer disc 150 (FIG. 4) removably mounted on the same axle 154 as the drive pulley 110 for the perforator rotor. This rotating synchronizer disc 150 is interchangeable with other similar discs each having a number of equispaced sensing points 152 (six in this instance) equal in number to the number of perforator blades 26 on the perforator rotor being used. A stationary sensor 156 produces one sync pulse per passage of each sensing point, and these sync pulses are used to control turning of the timing screw 146 for positioning each article in the banding station 144 aligned with the aimed position of each band 29 being ejected from the lower end 82 of the mandrel.

Adjusting inclination of chassis 9 around pivots 11 serves to adjust the height of the lower end 82 of the mandrel above the level of a conveyor 142 for accommodating runs of articles 140 of predetermined different heights and for optimizing aiming and spacing relationships between the lower mandrel end 82 and the tops of articles.

For using pre-perforated tubing to make and apply bands 29 to articles 140, the perforator rotor 24 is disconnected from its drive shaft 112 and is removed from the perforator 30. An infra-red source and an optical sensor 158 (FIG. 3) may be used as a photo sensor for sensing the passage of each separated band 29 for providing sync pulses for controlling turning of the timing screw 146.

Figure 8:
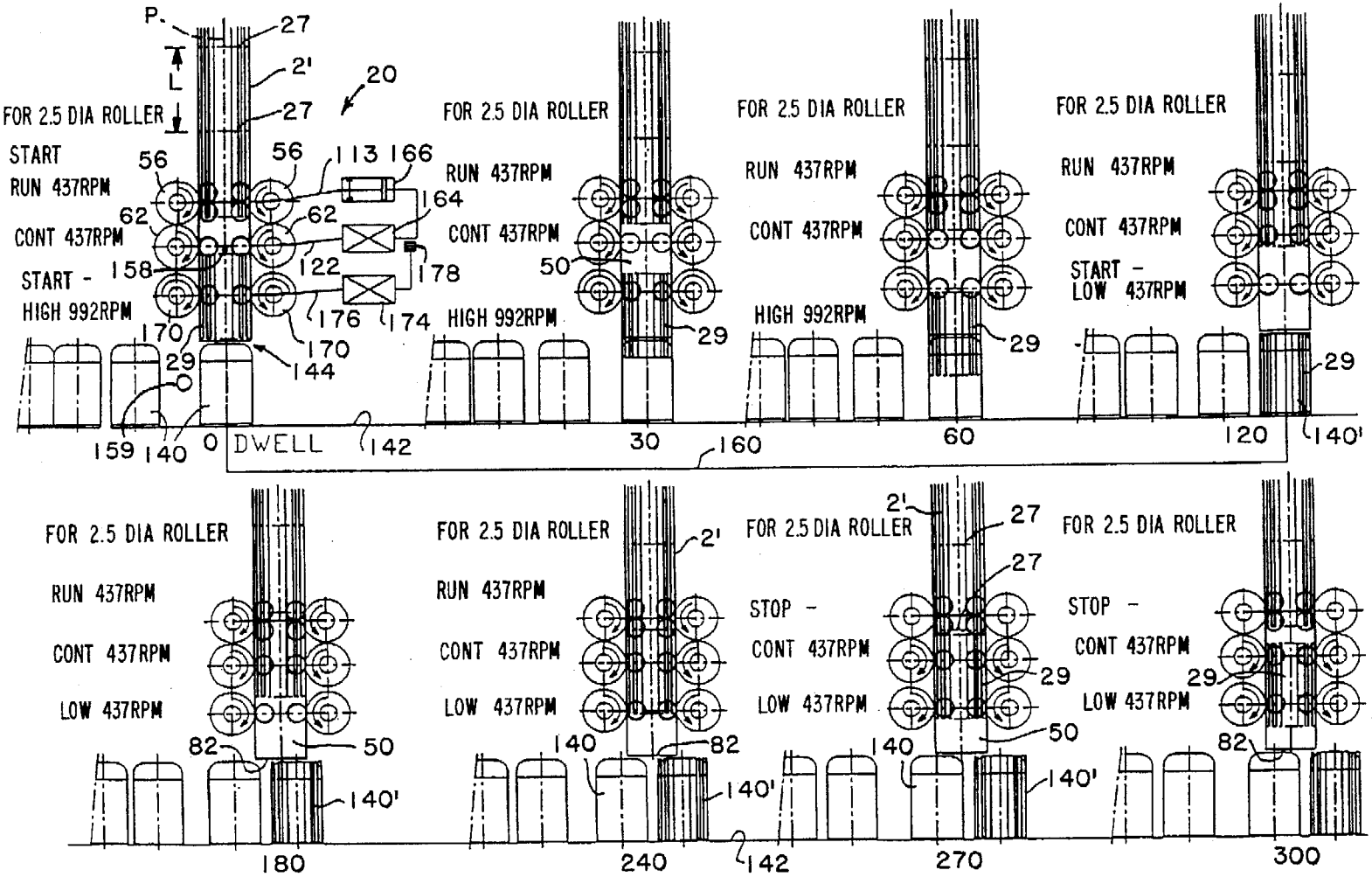
FIG. 8 shows method and apparatus employing three tiers of rollers for providing three different cyclic speed modes in sequence for accomplishing high-speed label banding: (1) run and stop feeding, (2) continuous tear-off speed matching feeding speed, and (3) acceleration push-off speeds initially matching continuous tear-off speed and then accelerating to more than two times continuous tear-off speed. One cycle of operation is defined as 0° to 360°, wherein 360° becomes 0° at the beginning of the next cycle.
Figures 1, 8A:
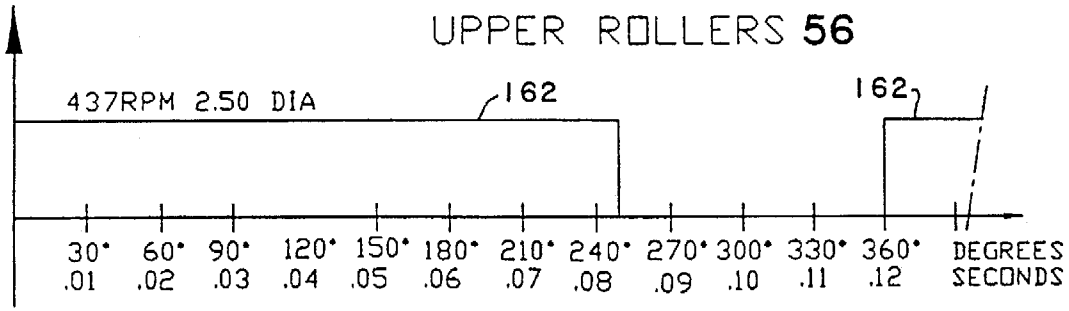
Figures 2, 8A:
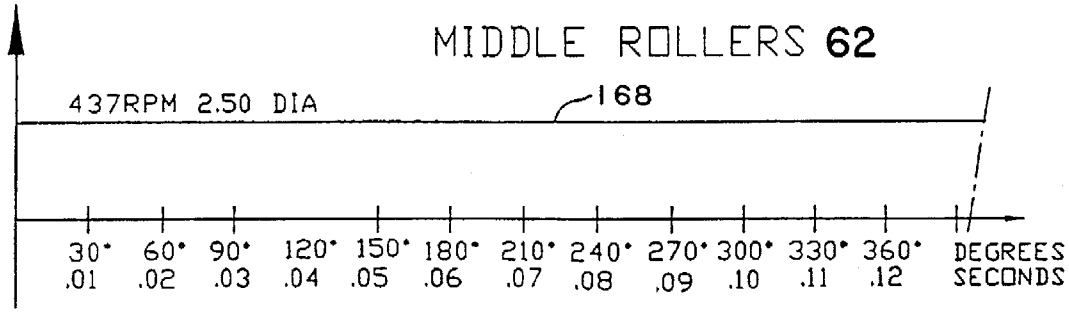
Figures 3, 8A:
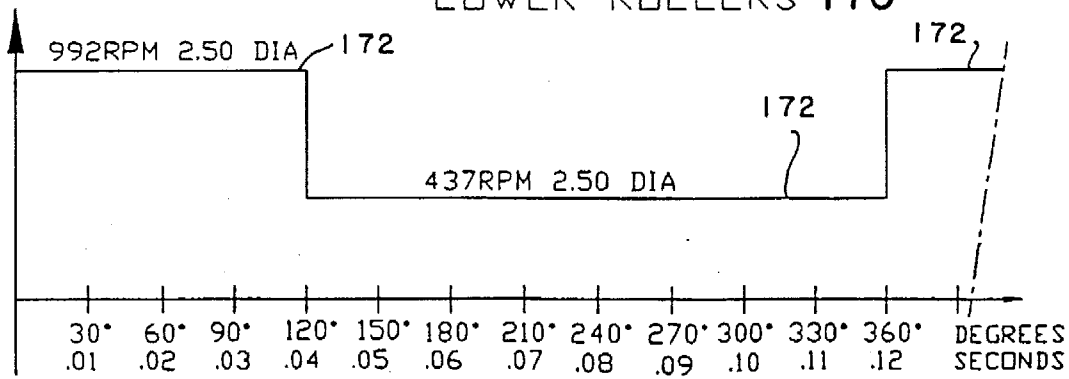

FIG. 8 includes a sequence of eight side elevational views showing a second embodiment of the invention portraying repeated cycles of operation occurring from 0° to 360°. 360° at the completion of one cycle corresponds with 0° at the beginning of the next cycle. For example, as shown in FIG. 8A one complete cycle may occur in 0.12 seconds for label banding articles 140 at a rate of 500 banded articles 140' per minute. Articles are advanced toward a banding station 144 by a continuously moving conveyor 142 which also removes banded articles 140' from the banding station. The incoming articles are controlled by a timing screw (not shown) such as screw 146 in FIGS. 1–3. Release of each article 140 from the timing screw so as to travel with the conveyor 142 is correlated to correspond with feeding of each torn-off band 29 downwardly along mandrel 50. For example such correlation may be provided by synch pulses from a photo sensor, such as sensor 158 shown in FIG. 3. A releasable clamp (not shown) momentarily restrains each article in alignment with the banding station 144, causing the restrained article to dwell there for an interval 160 (FIG. 8) corresponding to cycle time 0° to 120°, i.e., a dwell for one-third of a cycle amounting in time to 0.04 of a second.

Another way to correlate feeding of bands 29 with arrival of articles 140 in the banding station 144 is to provide a photo sensor 159 for sensing each article 140 approaching toward the banding station 144. Then, the operation of the banding method and apparatus 20 may be timed to correlate with arrival of the articles sensed at 159 as they approach the releasable restraining clamp in the banding station.

As shown by a plot 162 in FIG. 8A-1 upper (feed) rollers 56 provide start and stop feeding. They are shown having a diameter of 2.50 inches (circumference of 7.85 inches). Their starting may be correlated by photo sensor 159 with arrival of each conveyed article 140. They are shown rotating during cycle time 0° to 250° at 437 RPM, providing peripheral speed of 3,430 inches per minute (about 286 feet per minute) for feeding the perforated tubing 2' downwardly along mandrel 50 at a feed rate of about 286 feet per minute. A control program and an electromagnetic clutch-brake 166 causes feed rollers 56 to run from cycle time 0° to cycle time 250° and to be stopped from 250° to 360°. A continuously rotating DC motor 164 is shown driving the feed rollers 56 through the electromagnetically actuated clutch-brake 166 via suitable drive shafts 113. This motor 164 also continuously drives middle (tear-off) rollers 62 via suitable drive shafts 122. It is to be understood that there are a pair of drive shafts 113 and a pair of drive shafts 122 suitably driven so as to rotate each pair of drive shafts in opposite directions at the same rotational rate for counterrotating feed rollers 56 and for counterrotating middle rollers 62.

The rotational rate of DC motor 164 may be controlled by an operator by adjusting a potentiometer in a direct current energizing circuit for this motor. An RPM sensor associated with this motor provides signals to a suitable RPM display for indicating to an operator the rotational rate at which the motor 164 is running.

A plot 168 in FIG. 8A-2 shows middle (tear-off) rollers with a diameter of 2.50 inches rotating continuously at 437 RPM, thereby providing peripheral speed matching feed rollers 56 while the latter are feeding tubing downwardly during cycle time 0° to 250°. Between cycle times 60° and 120° as shown in FIG. 8, namely at about cycle time 90°, the lower end of descending tubing 2' comes into contact with, i.e., is engaged by, continuously turning tear-off rollers 62 which begin helping the feed rollers 56 in pulling tubing downwardly around the mandrel during cycle time from 90° to 250°. The length L of the label tubing between transverse perforations 27 is sufficient for its lower end to come into contact with, i.e., to be engaged by, acceleration push-off rollers 170 while still engaged by tear-off rollers 62. These acceleration push-off rollers also are shown having a diameter of 2.50 inches and rotating at 437 RPM during cycle time 120° to 360° as shown by plot 172 (FIG. 8A-3) for matching their peripheral speed with the middle and upper rollers during that portion of a cycle. Thus, as shown in FIG. 8, the acceleration and push-off rollers 170 are helping in cooperating with upper and middle rollers for feeding the tubing farther down around the mandrel during cycle time 230° to 250°, when tear-off occurs as explained below. The acceleration and push off rollers 170 are suitably driven in opposite directions at equal rotational rates by a servomotor 174 via suitable drive shafts 176 (only one of which is shown in FIG. 8).

To control the servomotor 174 so that it rotates in synchronism with and at the same rate as motor 164 during cycle time 120° to 360°, as is shown by plot 172 (FIG. 8A), there is a shaft encoder 178 which is on a shaft of motor 164. This shaft encoder controls the rotational rate of servomotor 174 so it is synchronized with rotational rate of DC motor 164 during cycle time 120° to 360°.

At cycle time 250°, feed rollers 56 are stopped by clutch 166 thus stopping descent of tubing 2' for enabling tear-off of a band 29 from the tubing. Middle and lower rollers are both turning at the same peripheral speed as the tubing 2' previously was descending, and so they cooperate with each other in tearing off a band 29 from the now-stopped tubing. Cycle time 270° shows a band 29 recently torn off from tubing 2' and being propelled down along the mandrel 50 by cooperative propelling action of the middle and lower rollers. This cooperative propelling action of middle and lower rollers continues through cycle time 300° and continues until the trailing edge of the band 27 has passed the middle rollers which occurs after cycle time 300° and prior to cycle time 360° (0°). Thus, prior to cycle time 0° the descending label band 29 becomes engaged only by acceleration and push-off rollers 170; so it is positioned ready to be accelerated.

At about cycle time 360° (0°) a photosensor 158 (FIG. 8), which may be similar to the photosensor 158 (FIG. 3), signals that the torn-off band 29 now has progressed far enough down for its upper edge to be below contact with the tear-off rollers 62. Thus, the torn-off band is free of the tear-off rollers and is ready to be accelerated. This signal from sensor 158 causes a control program to increase servomotor speed to a predetermined higher speed, for example in this instance 992 RPM, at which the servomotor runs from cycle time 0° to 120°. This sudden increase in speed of rollers 170 from 437 RPM to 992 RPM provides a peripheral speed of 7,790 inches per minute or about 649 feet per minute, namely about 2.27 times faster than their slower rate which was synchronized with motor-164. This faster band-propelling rate continues as described above from cycle time 0° to 120° for accelerating a lengthy label band 29 and for propelling it downwardly along the mandrel at a speed about 2.27 times faster than the speed at which the tubing is fed. With this fast travel the band is ejected from the lower end 82 of the mandrel, and its kinetic energy carries it down around an article 140 during dwell time 160 (FIG. 8) of 0.04 of a second. At cycle time 120°, the servomotor 174 is programmed again to be running controlled by shaft encoder 178 so as to run synchronized with speed of DC motor 164.

Auxiliary push-down means (not shown) such as rapidly counterrotating cloth buffing wheels or brushes mounted on opposite sides of the conveyor 142 may be employed in or near the banding station 144 for lightly applying downwardly-acting frictional force against opposite sides of a label band 29 after cycle time 120° when the band is intended to be down around the banded article 140' for assuring that the label band is fully seated down.

It is noted that there may be two or four of the acceleration push-off rollers 170. They each have an opposed, reely-rotating companion roller mounted inside of the mandrel. When there are four rollers 170 they are substantially symmetrically spaced around the circular cylindrical periphery 90 of the mandrel 50 for substantially uniformly distributing acceleration stresses in the film-like wall of each label band.

Figure 9:
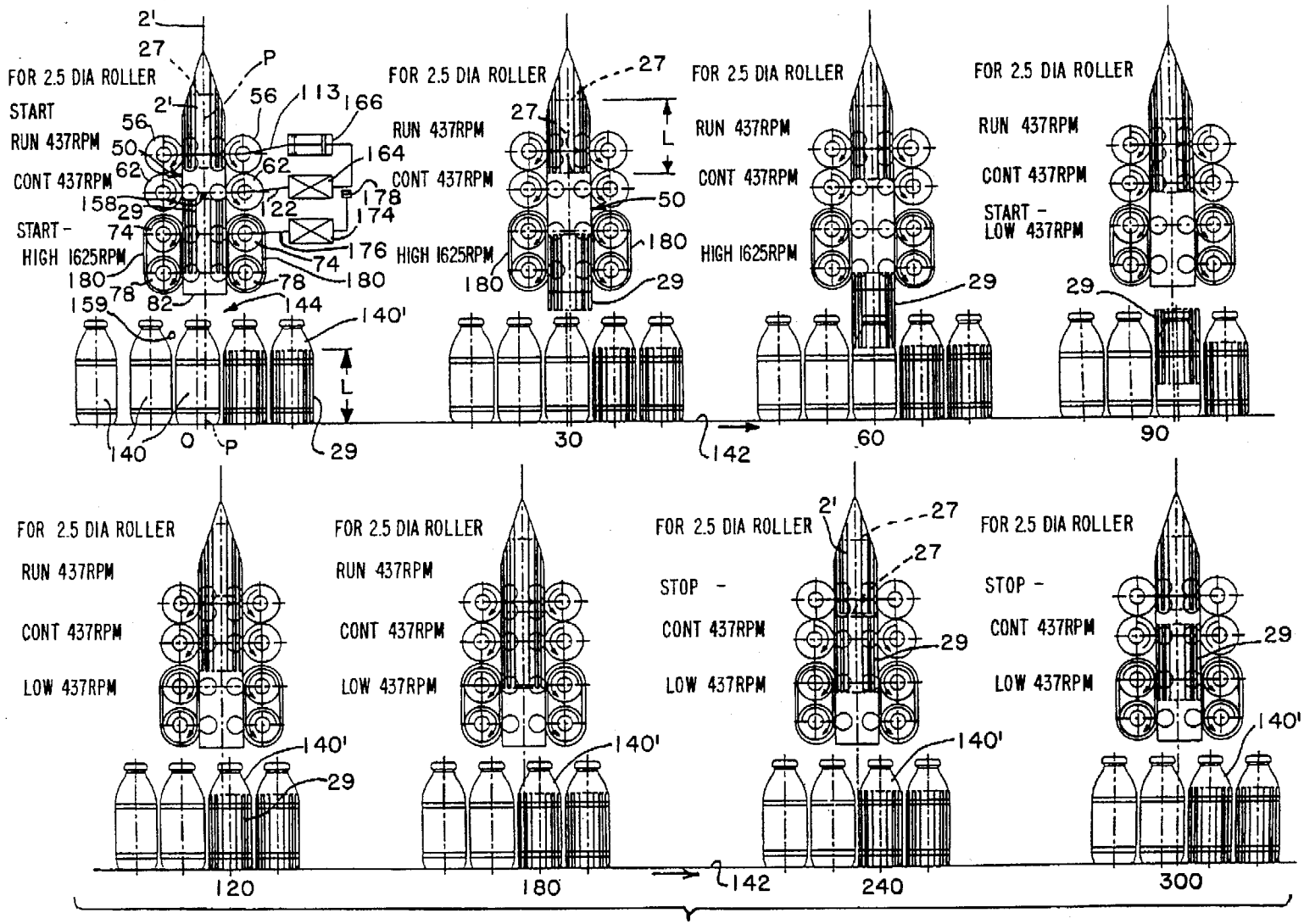
FIG. 9 shows method and apparatus employing two tiers of rollers and one tier of belts for providing three different cyclic speed modes in sequence for accomplishing high-speed label banding: (1) run and stop feeding; (2) continuous tear-off speed matching feeding speed, and (3) acceleration push-off speeds provided by revolving belts initially matching continuous tear-off speed and then accelerating to more than three times continuous tear-off speed. Tall articles are being continuously conveyed through a banding station, and high-speed label banding takes place while the articles continue to be conveyed forward through the banding station.
Figure 10:
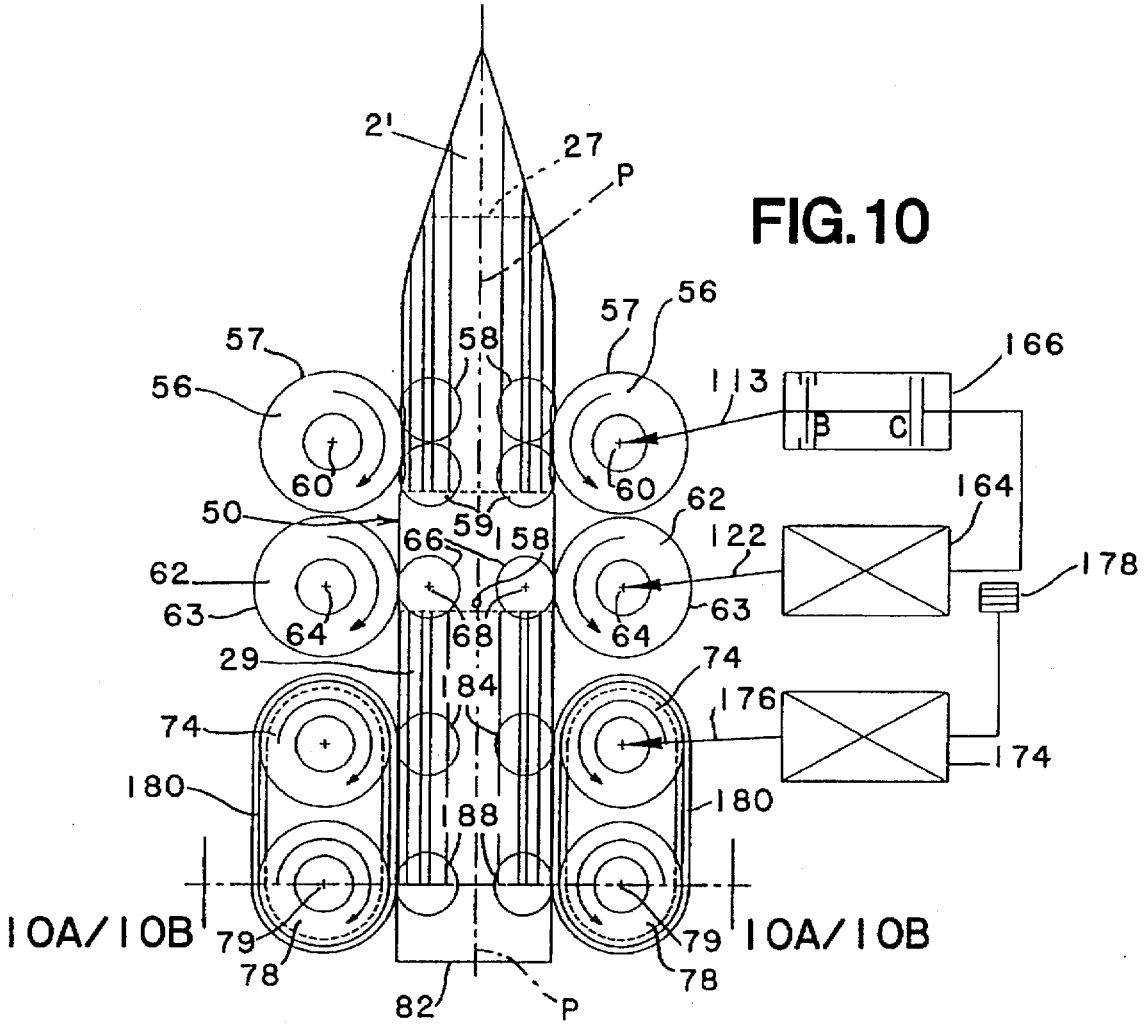
FIG. 10 is an enlargement of the upper left portion of FIG. 9 wherein the components are shown at the beginning of a cycle of operation.

FIG. 9 includes a sequence of eight side elevational views showing a third embodiment of the invention illustrating repeated cycles of operation occurring from 0° to 360°, similar to the cycles of operation shown in FIGS. 8 and 8A. The articles 140 are continuously advanced by the conveyor 142 as bands are applied. The acceleration push-off members 180 are shown as belts (Please see also FIGS. 10 and 10A) revolving in oval paths around drive pulleys 74 and idler pulleys 78. These belts are shown circular in cross section and having a high friction surface. They run in peripheral grooves on the pulleys 74 and 78. These grooves have generally a semi-circular shape. These pulleys have opposed, freely-turning companion rollers 184, 188 mounted inside of the mandrel. Thus the high-friction belts 180 firmly frictionally grip the wall of tubing where it is captured between the internal rollers 184, 188 and the external acceleration push off belts 180 where they are supported by their pulleys 74 and 78.

The start and stop feed rollers 56 are shown running at 437 RPM from 0° to 240° and being stopped from 240° to 360°. The middle (tear-off) rollers 62 are shown running continuously at 437 RPM. The acceleration push off belts 180 have peripheral speed corresponding to a diameter of about 2.50 inches where the belts are in firm contact with the tubing moving downwardly between the pulleys and their companion rollers. The belt drive pulleys 74 run at 437 RPM from cycle time 60° to 360° so peripheral speed of the belts 180 substantially matches peripheral speed of middle and upper rollers during cycle time 90° to 240° and substantially matches peripheral speed of middle rollers from 90° to 360°. As will be understood from FIG. 9, the middle rollers 62 begin helping feed rollers 56 at about cycle time 75° in feeding perforated tubing 2' down around the mandrel 50. Then, at cycle time 180° the belts 180 are shown in FIG. 9 to have commenced helping the middle and upper rollers in feeding the tubing.

At about cycle time 240° when feed rollers 56 are stopped by clutch-brake 166, the combined downward pull of rollers 62 and belts 180 serves to tear a label band 29 off from the tubing. The severed band continues to be fed down by rollers 62 and belts 180 from cycle time 240° until just prior to cycle time 360° (0°).

At cycle time 0°, the upper edge of the torn-off band 29 has moved down below the tear-off rollers 62 and a suitable photo sensor 158 causes a control program to increase speed of the belt-drive pulleys 74 from 437 RPM to 1625 RPM. The control program continues this fast speed until cycle time 90°, thereby providing a greatly increased peripheral speed of the belts of about 12,760 inches per minute or about 1,060 feet per minute (about 12 miles per hour) during cycle time 0° to 90°. This fast speed is about 3.70 times faster than the speed of about 286 feet per minute at which the label tubing 2' is fed downwardly around the mandrel. This faster rate accelerates a label band and propels it downwardly at this fast rate of travel, so that the label band is ejected fully from the lower end 82 of the mandrel at about cycle time 75° as understood from FIG. 9. Its kinetic energy carries it down around a tall article 140 which is being continuously carried by conveyor 142 through the banding station.

It is noted that this acceleration of elongated sleeve label bands to such speed enables tall articles 140 to be conveyed continuously at a significant rate of at least 500 articles per minute through the banding or sleeve labelling station 144. Moreover, gripping the lower end of each sleeve band 29 between the lower companion rollers 188 and the acceleration push off belts 180 running on idler pulleys 78 advantageously applies tension along the length of the thin-walled plastic sleeve bands for avoiding crumpling or distortion while the bands are being accelerated and propelled downwardly at high speed around the mandrel. As seen at cycle time 0°, this tension initially is applied near the lower end of the relatively long sleeve band so that it essentially is being pulled down from the bottom rather than being pushed down at the top.

At cycle time 90° the servomotor 174 is programmed again to be running controlled by shaft encoder 178 so as to run synchronized with speed of DC motor 64.

Figure 10A:
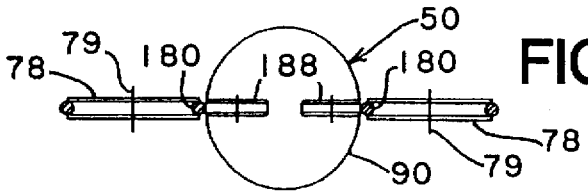
FIG. 10A is a sectional view of FIG. 10 taken along the plane 10A—10A, looking downwardly.

FIG. 10A shows two high-friction-surface acceleration push-off belts 180 of circular cross section positioned on opposite sides of the plane P and revolving in a plane oriented perpendicular to plane P.

Figure 10B:
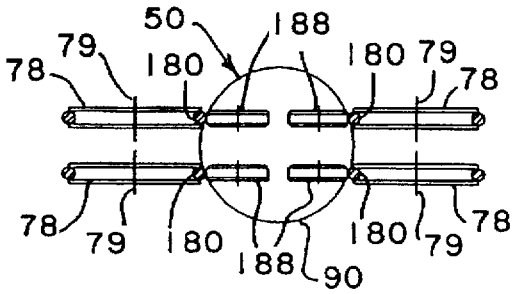
FIG. 10B is a sectional view taken along the plane 10B—10B in FIG. 10 looking downwardly showing another embodiment of the invention employing four acceleration and push-off belts.

FIG. 10B shows four of these acceleration push-off belts 180 revolving in spaced parallel planes which are oriented perpendicular to plane P. Pairs of these belts are on opposite sides of plane P, and their drive pulleys 74 and idler pulleys 78 have respective aligned axes as represented in FIG. 10B.

Figure 10C:
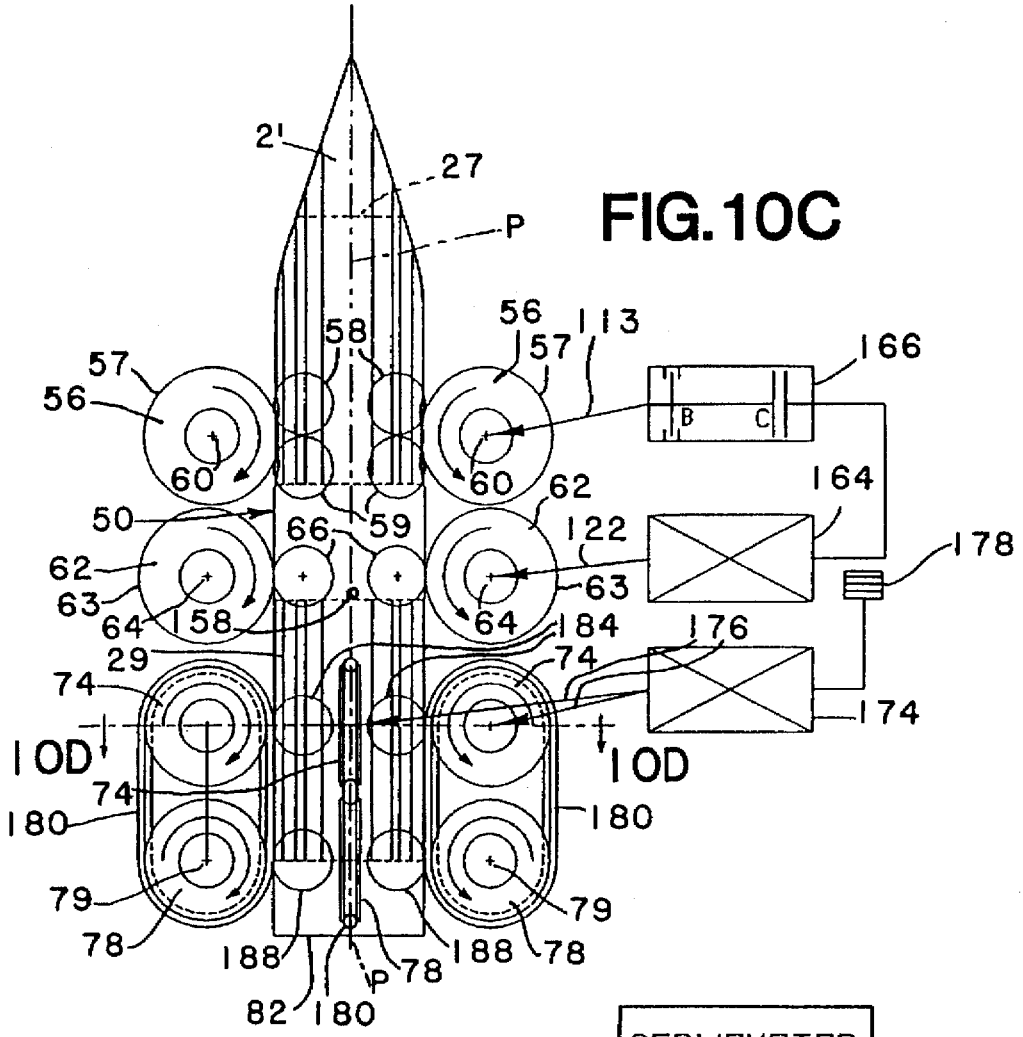
FIG. 10C shows method and apparatus of the invention similar to FIG. 10, but having four acceleration and push-off belts equispaced around the mandrel.
Figure 10D:
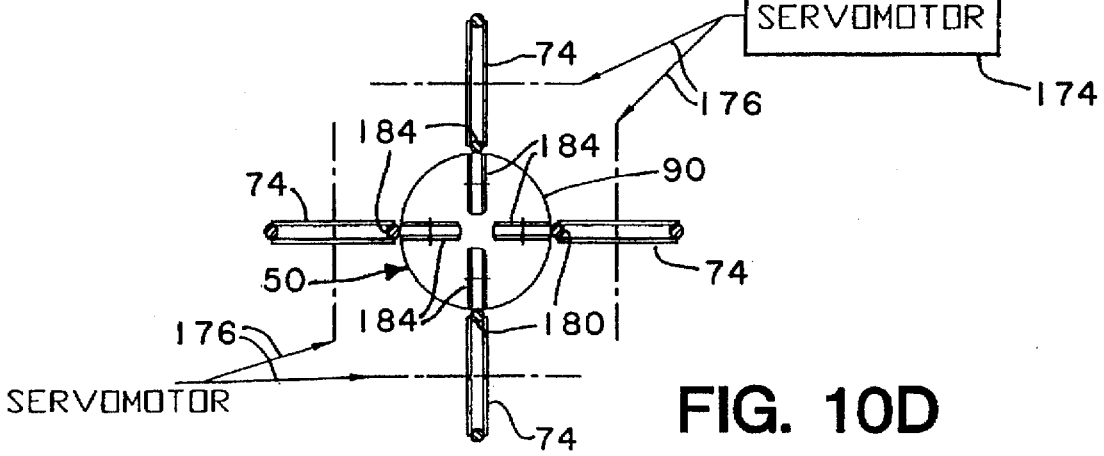
FIG. 10D is a sectional view taken along the plane 10D—10D in FIG. 10C looking downwardly showing the four acceleration and push-off belts symmetrically positioned around the mandrel.

FIG. 10C shows four of these belts 180 revolving in planes substantially symmetrically positioned around the circular cylindrical mandrel surface 90. By employing tortionally-stiff, flexible drive shafts 176, one servomotor 174 may be used for driving all four of the pulleys 74.

Auxiliary push-down means (not shown) as described in connection with FIG. 8, may be employed in the apparatus of FIG. 9 for lightly applying downwardly-acting frictional force against opposite sides of a band 29 after cycle time 120° when a label band is intended to be down around the banded article 140' for assuring that the label band is fully seated down.

It is noted that drive means 164, 166 and 174 shown in FIGS. 8, 9, 10 and 10C can be used in the machine 10 instead of the drive and transmission 100. The clutch-drive 166, the DC motor 164 and the servomotor 174 serve to turn counterrotating gears for counterrotating their respective pairs of drive shafts 113, 122 and 176 for counterrotating the upper, middle and lower rollers (FIG. 8) or the upper and middle rollers and lower belt-drive pulleys (FIG. 9) at respective rates for their respective cyclic operations as described. The tubing supply feed roller 5 (FIG. 3) may be driven by a separate motor (not shown) controlled by sensors 128, 130.

Figure 11:
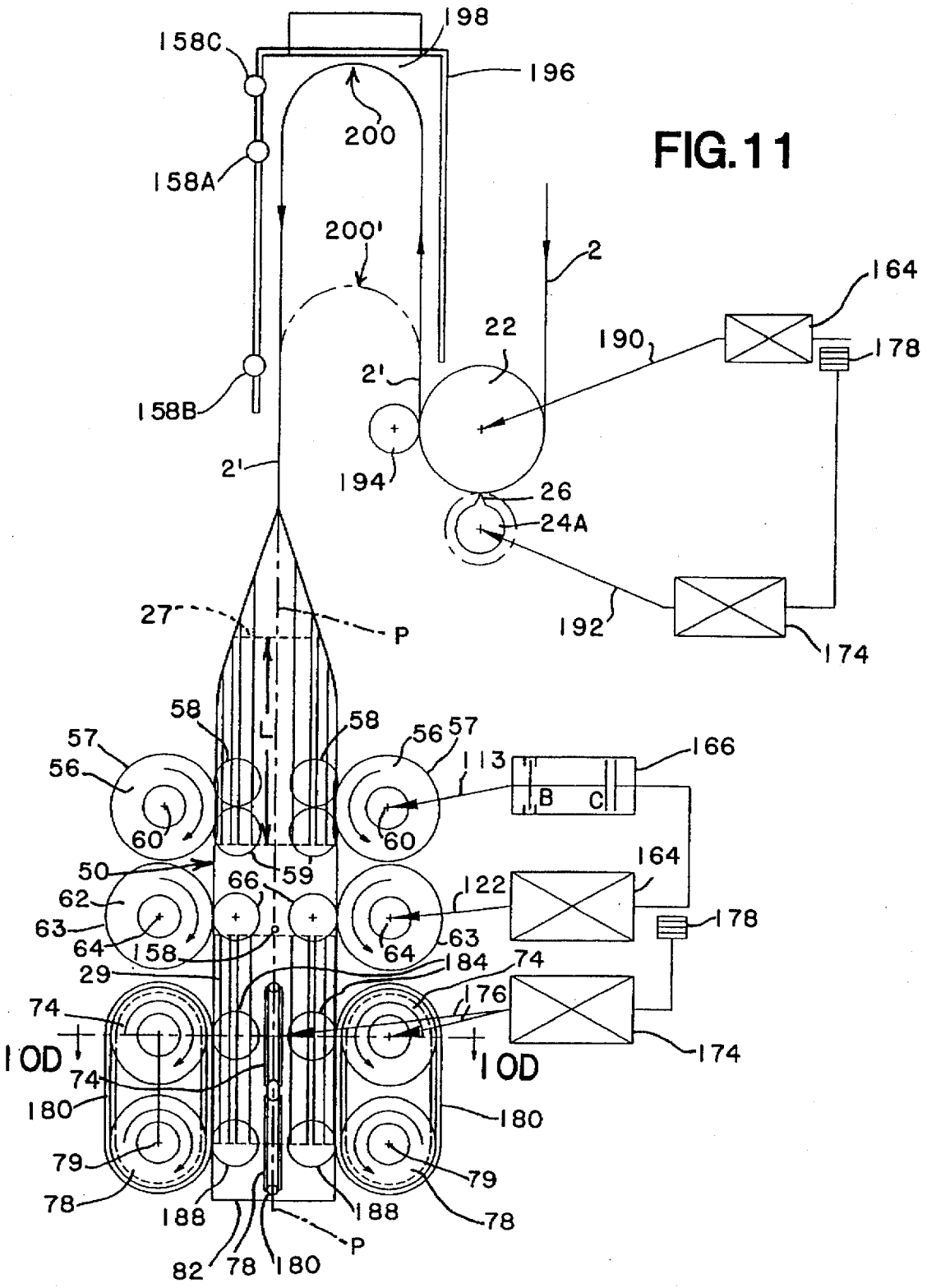
FIG. 11 illustrates method and apparatus of another embodiment of the invention in which a servomotor is shown driving a rotary perforator for enabling convenient production changes of band lengths.

In FIG. 11 the mandrel 50 and associated components are shown identical with those in FIG. 10C. The incoming tubing 2 in FIG. 11 is shown travelling downwardly. For example, this incoming tubing may be travelling down from a roller such as roller 18 (FIG. 3), and the tubing may be supplied by apparatus shown upstream of roller 18 in FIGS. 2 and 3. The tubing runs half-way around an anvil roller 22 whose shaft 190 is rotationally driven at an adjustable constant speed by a DC motor 164 having a shaft encoder 178 controlling a servomotor 174 for driving a shaft 192 of a rotary perforator 24A shown having a single blade 26. A roller 194 holds the tubing firmly against the surface of the anvil roller 22 so that this anvil roller feeds perforated tubing 2' upwardly into a vacuum (suction) box 196.

During each perforation of the tubing 2, the servomotor 174 rotates the perforator 24A so that tip speed of its perforator blade 26 matches surface speed of the anvil roller 22. During time intervals between performance of each perforation, the servomotor 174 may be programmed to turn the perforator 24A at a relatively slow speed or may be programmed to stop rotation of the perforator. A potentiometer in a direct current energizing circuit for DC motor 164 may be used by an operator to adjust a desired level of average constant speed of this motor. Motor speed is sensed by an RPM sensor with an RPM display for indicating to an operator the running speed of this motor.

Within the vacuum box 196, a reduced air pressure in a region 198 above the perforated tubing 2' causes this tubing to loop upwardly as indicated in dash and dotted outline in an inverted bend 200 into this box, and then the tubing 2' travels downwardly from loop 200 toward the mandrel 50. The position of the top of the inverted U-bend 200 rises and falls within the vacuum box 196 as indicated at 200' depending upon average surface speed of the anvil roller 22 as driven by DC motor 164 compared with the average rate at which perforated tubing 2' is being fed down around the mandrel 50.

The operator sets the desired level of average constant speed of the DC motor 164 as explained above. Additionally, a loop low speed photo sensor 158A senses location of the top of the inverted U-bend loop 200. This photo sensor 158A is connected in a motor speed control for the DC motor 164 for causing motor speed to reduce slightly, for example by a reduction in a range of about 0.05% to about 3% below the level of average constant motor speed, whenever the top of inverted U-bend loop 200 rises up into the box 196 to the location of this sensor 158A.

A loop high speed photo sensor 158B in the motor speed control for DC motor 164 causes motor speed to increase slightly, for example by an increase in a range of about 0.05% to about 3% above the level of average constant motor speed, whenever the top of U-bend loop 200 lowers downwardly in the box 196 to the location of this lower sensor 158B. A third photo sensor 158C positioned near the top of the vacuum box 196 serves as a limit stop in the motor speed control for the DC motor 164 for stopping this motor whenever the top of inverted U-bend loop 200 rises up to the location of this limit stop sensor 158C.

The length L of tubing between transverse perforations 27 conveniently is adjusted for adjusting band length L by adjusting programmed time intervals between performance of successive perforations for allowing the anvil roller 22 to feed a desired length of tubing past the perforator 24A between each perforating operation. The production rate of bands per minute conveniently is adjusted by adjusting speeds of the two DC motors 164.

Since other changes and modifications varied to fit particular operating requirements and environments will be recognized by those skilled in the art, the invention is not considered limited to the examples chosen for purposes of illustration, and includes all changes and modifications which do not constitute a departure from the true spirit and scope of this invention as claimed in the following claims and equivalents thereto.

We claim:

1. Apparatus for banding articles with plastic bands torn off from plastic tubing having transverse perforations at predetermined intervals, said banding apparatus comprising:

means for supplying flattened plastic tubing having transverse perforations extending across the tubing at predetermined intervals uniformly spaced at distances L along the tubing;

a floating mandrel sized to fit slidably inside of the tubing for entering the flattened perforated tubing for opening it into opened tubing and for holding open the perforated tubing;

continuously rotating feed rollers for engaging the opened perforated tubing adjacent to the mandrel for continuously feeding the perforated tubing downstream around the mandrel;

said continuously rotating feed rollers having axes, said axes of the feed rollers both lying in a first transverse plane extending transversely with respect to the mandrel;

sets of freely-rotatable upper and lower suspension rollers mounted inside of the mandrel, the upper and lower suspension rollers in each set being spaced above and below said first transverse plane, with a set of said suspension rollers being in opposed relation to each of said feed rollers for suspending the floating mandrel;

said feed rollers in cooperation with their respective sets of upper and lower suspension rollers serving dual functions of suspending the mandrel and also of continuously feeding the perforated tubing downwardly around the mandrel;

continuously rotating tear-off rollers positioned downstream from said continuously rotating feed rollers for imparting continuously moving downstream-directed tear-off motion to the opened perforated tubing as the opened perforated tubing continuously moves downstream around the mandrel;

said downstream-directed tear-off motion being sufficiently faster than the feed rollers continuously move the opened perforated tubing downstream around the mandrel for accelerating and tearing off successive lengths L of opened perforated tubing at said transverse perforations for forming successive bands of length L spaced one from another along the mandrel and continuously moving downstream around the mandrel at predetermined higher speed than the opened perforated tubing continuously moves;

said continuously rotating tear-off rollers having axes lying in a second transverse plane extending transversely with respect to the mandrel;

each tear-off roller having an opposed freely-rotatable companion roller mounted inside of the mandrel;

said companion rollers having their axes positioned in said second transverse plane for providing aligned rolling contact of said companion rollers and said tear-off rollers against inner and outer surfaces of each band which is torn off from the opened perforated tubing;

continuously revolving push-off means engaging successive bands at at least two positions around the mandrel for pushing successive bands downstream along the mandrel at higher speed along the mandrel than said perforated tubing continuously moves and then for propelling them off from an end of the mandrel, thereby advantageously accomplishing these steps all with continuous motion: (i) opening flattened perforated tubing by the mandrel and (ii) feeding perforated tubing downstream along the mandrel and (iii) tearing successive bands off from continuously moving perforated tubing and (iv) pushing successive bands downstream along the mandrel and (v) propelling the bands off from the mandrel.

2. Banding apparatus as claimed in claim 1, wherein:

said continuously moving push-off means impart an ejection acceleration thrust to each band being propelled off from the end of the mandrel for imparting a final kick to the ejected band to increase kinetic energy of the band being ejected and aimed toward an article to be banded.

3. Banding apparatus as claimed in claim 1, wherein:

the flattened perforated tubing as it approaches the floating mandrel is in a plane P which extends longitudinally along the floating mandrel; and stabilizing rollers are mounted on opposite sides of the mandrel centered on plane P, and each stabilizing roller has a freely-rotatable companion roller mounted inside of the mandrel in aligned rolling contact of the companion roller and stabilizing roller against inner and outer surfaces of the perforated tubing moving downstream around the mandrel.

4. Banding apparatus as claimed in claim 3, wherein:

the mandrel has a wedge-shaped transition end with a ridge at an upstream end of the mandrel lying in plane P and extending transversely of the mandrel;

the wedge-shaped transition end has a pair of generally isosceles-shaped triangular faces extending downstream from the ridge and being on opposite sides of plane P and diverging one from the other in the downstream direction and each having a vertex with the two vertices positioned directly opposite each other on opposite sides of plane P; and the stabilizing rollers are at rolling contact positions located near a level of the vertices.

5. Banding apparatus as claimed in claim 4, wherein:

the wedge-shaped transition end provides a constant distance around its periphery at each successive position downstream therealong.

6. Banding apparatus as claimed in claim 1, wherein:

perforator means are positioned upstream from the floating mandrel, and said perforator means include a perforator rotor positioned in opposed relationship to an anvil roller;

said perforator rotor is rotatably driven around an axis extending transversely relative to tubing length;

said perforator rotor carries a plurality of perforator blades extending parallel with said axis;

said blades have tips all at a same uniform radial distance from said axis;

the flattened plastic tubing travels partially around the anvil roller and then travels between the anvil roller and the tips of blades of the rotating perforator rotor for transversely perforating the flattened plastic tubing at said uniformly spaced distances L; and said continuously rotating feed rollers have a peripheral speed 0.03% to 0.5% greater than tip speed of said perforator blades for maintaining the continuously moving perforated tubing under tension in travelling from the perforator means toward and onto the mandrel.

7. Banding apparatus as claimed in claim 1, wherein:

flattened perforated tubing approaching the floating mandrel lies in a plane P, and said plane P extends longitudinally along the mandrel;

said continuously rotating feed rollers are positioned on opposite sides of the mandrel on opposite sides of the plane P for rolling contact with the opened perforated tubing on opposite sides of plane P;

continuously rotating first and second tear-off rollers are positioned below said continuously rotating feed rollers on opposite sides of the mandrel on opposite sides of the plane p for rolling contact with the opened perforated tubing on a first and second side of plane P, respectively;

said mandrel has first, second, third and fourth parallel channels extending downstream along the mandrel toward the end of the mandrel with said first and second channels being on said first side of the plane P and said third and fourth channels being on said second side of the plane P;

first and second toothed belt-drive pulleys on said first axis with said first tear-off roller being between said first and second belt-drive pulleys, said first and second belt-drive pulleys rotating continuously with said first tear-off roller, and said first and second belt-drive pulley and said first tear-off roller being on the first side of the plane P;

third and fourth toothed belt-drive pulleys on said second axis with said second tear-off roller being between said third and fourth belt-drive pulleys, said third and fourth belt-drive pulleys rotating continuously with said second tear-off roller, and said third and fourth belt-drive pulleys and said second tear-off roller being on the second side of plane P;

first, second, third and fourth push-off belts have teeth engaging in positive drive relationship with said first, second, third and fourth belt-drive pulleys, respectively, for continuously revolving said belts with a portion of each of the first, second, third and fourth belts travelling parallel with said first, second, third and fourth channels, respectively, toward the end of said mandrel;

said first, second, third and fourth belts each having a plurality of pusher elements projecting outwardly from the belt and being equispaced along the length of the belt; and pusher elements on the respective four belts simultaneously entering into and travelling along the respective four channels toward the end of the mandrel with pusher elements on the first and second belts being on the first side of the plane P and with pusher elements on the third and fourth belts being on the second side of the plane P for simultaneously engaging against four substantially equispaced regions on a trailing edge of each band with two of said regions being on the first side of plane P and two of said regions being on the second side of plane P for pushing each band at high speed along the mandrel without undue distortion and then pushing each band off from the end of the mandrel toward an article to be banded.

8. Banding apparatus as claimed in claim 7 wherein:

the four belts revolve around four respective idler pulleys mounted adjacent ends of the four respective channels near the end of the mandrel; and in revolving around said idler pulleys, tips of the elongated pusher elements swing around the idler pulleys moving faster than the belts, thereby imparting an ejection acceleration to each band being propelled off from the end of the mandrel.

9. Banding apparatus as claimed in claim 8 wherein:

said pusher elements are elongated outwardly from each belt;

said pusher elements project from the first and second push-off belts in parallel relationship, and said pusher elements project from the third and fourth push-off belts in parallel relationship; and the pusher elements project from an outer surface of each belt by a dimension D at least 70% of the radius R of the respective belt-drive pulley.

10. Banding apparatus as claimed in claim 9, wherein:

the mandrel has a cylindrical configuration adjacent to said first, second, third and fourth parallel channels;

said channels are substantially equispaced around said cylindrical configuration; and said dimension D is at least 40% of a distance from said axes of said companion rollers to said plane P for reaching said pusher elements into said equispaced channels for simultaneously engaging and simultaneously pushing downwardly against four substantially equispaced regions of an upper edge of each band.

11. Banding apparatus as claimed in claim 9, wherein:

the four respective idler pulleys each have a radius larger than the radius R of the first, second, third and fourth belt-drive pulleys for enlarging a radius of swing of the tips of the elongated pusher elements in revolving around the idler pulleys relative to a radius of swing of these tips in revolving around the belt-drive pulleys for preventing a final swinging kick of the elongated pusher elements against the upper edge of each ejected band from applying an undue component of kick motion outwardly in a direction away from the plane P while providing a downward component of kick motion in a direction parallel with plane P significantly effective in a desired downward propulsion direction.

12. Banding apparatus as claimed in claim 1, wherein:

flattened perforated tubing approaching the floating mandrel lies in a plane P, and said plane P extends longitudinally along the mandrel;

the mandrel has a wedge-shaped transition end with a ridge lying in plane P and extending transversely of the mandrel at an upstream end of the mandrel;

the wedge-shaped transition end has a pair of generally isosceles-shaped triangular faces extending downstream from the ridge and being on opposite sides of plane P and diverging one from the other in the downstream direction and each having a vertex with the two vertices positioned directly opposite each other on opposite sides of plane P;

the mandrel has a generally cylindrical configuration extending downstream from the two vertices; and the wedge-shaped transition end provides a constant distance around its periphery at each successive position downwardly therealong.

13. Banding apparatus as claimed in claim 1, wherein:

said continuously rotating feed rollers have rims of high friction material with the rims of said feed rollers moving at a first peripheral speed;

said continuously rotating tear-off rollers have rims of high friction material; and the rims of said tear-off rollers are moving at a second peripheral speed more than three times the peripheral speed of the rims of the feed rollers for accelerating the resulting torn-off bands to a velocity more than three times the continuous feed speed of the perforated tubing for minimizing dwell time of articles near the end of the mandrel for increasing production rate of banded articles.

14. Banding apparatus as claimed in claim 1, wherein:

there are a plurality of belt-drive pulleys;

at least one of said belt-drive pulleys is mounted on each axis of a continuously-rotating tear-off roller and is continuously rotating at the same rate of rotation as the continuously-rotating tear-off roller;

each belt-drive pulley is a toothed pulley;

there are a plurality of toothed belts;

each of said belt-drive pulleys has a respective one of said toothed belts engaged in positive drive relationship therewith for continuously revolving the toothed belts;

each of the toothed belts revolves around an idler pulley mounted near a downstream end of the mandrel;

each of the toothed belts has a plurality of pusher elements projecting therefrom equispaced along the toothed belt;

the mandrel has a plurality of channels extending downstream therealong; and pusher elements on all toothed belts simultaneously enter into and travel downstream along said channels for pushing successive bands downstream along the mandrel and off from the downstream end of the mandrel.

15. Banding apparatus as claimed in claim 7, wherein:

said pusher elements project from the first and second push-off belts in parallel relationship, and said pusher elements project from the third and fourth push-off belts in parallel relationship;

said pusher elements are elongated in a direction outwardly from each belt and each pusher element has an outer end spaced away from an outer surface of the belt;

the outer ends of the pusher elements on the first and second push-off belts in revolving around the first and second belt-drive pulleys approach more closely to the plane P than the rim of the first continuously rotating tear-off roller;

the outer ends of the pusher elements on the third and fourth push-off belts in revolving around the third and fourth belt-drive pulleys approach more closely to the plane P than the rim of the second continuously rotating tear-off roller; and spacing of the outer ends of the pusher elements from the plane P is less than 75% of spacing of the rims of the tear-off rollers from the plane P.

16. Apparatus for banding articles with plastic bands torn off from tubing having transverse perforations at predetermined intervals, said banding apparatus comprising:

means for supplying flattened plastic tubing having transverse perforations extending across the tubing at predetermined intervals uniformly spaced along the tubing at distances L, with each interval of length L corresponding to an axial length of a band;

a floating mandrel sized to fit slidably inside of the tubing for entering the flattened tubing for opening it into opened tubing and for holding open the tubing;

feeding rollers for engaging the opened tubing adjacent to the mandrel for feeding the opened tubing downstream along the mandrel;

said feeding rollers having parallel axes positioned on opposite sides of the mandrel;

said parallel axes of the feeding rollers both lying in a first transverse plane extending transversely with respect to the mandrel;

sets of freely-rotatable upper and lower suspension rollers mounted inside of the mandrel, the upper and lower suspension rollers in each set being spaced above and below said first transverse plane with a set of said suspension rollers being in opposed relation to each feeding roller for suspending the floating mandrel;

said feeding rollers in cooperation with their respective sets of suspension rollers serving dual functions of suspending the mandrel and also of feeding the tubing downwardly around the mandrel;

continuously rotating tear-off rollers positioned downstream from said feeding rollers for engaging opened tubing adjacent to the mandrel for imparting downstream-directed tear-off motion to the opened tubing for tearing off successive intervals of length L of the opened tubing at the transverse perforations for forming successive bands of length L;

said continuously rotating tear-off rollers having parallel axes positioned on opposite sides of the mandrel;

said parallel axes of the tear-off rollers lying in a second transverse plane extending transversely with respect to the mandrel;

each of the tear-off rollers having an opposed freely-rotatable companion roller mounted inside of the mandrel;

said companion rollers having axes in said second transverse plane for providing aligned rolling contact of the tear-off rollers and their respective companion rollers against outer and inner surfaces of the successive torn-off bands; and pushing means positioned downstream from the continuously rotating tear-off rollers for pushing the torn-off bands at a second speed suitably faster than the speed at which the feeding rollers feed downwardly the opened tubing for ejecting each band from an end of the mandrel aimed at an article to be banded with speed to carry the ejected onto an article for minimizing dwell time for placing bands on articles at a rate of at least 500 articles per minute.

17. Apparatus for banding articles with plastic bands as claimed in claim 16, wherein:

the pushing means push the bands as a speed of at least three times the speed at which the feeding rollers feed downwardly the opened tubing.

18. Apparatus for banding articles with plastic bands as claimed in claim 16, wherein:

the pushing means push the bands at a speed of more than 1,000 feet per minute.

19. Apparatus for banding articles with plastic bands as claimed in claim 16, wherein:

the length L of the bands is sufficient for both the tear-off rollers and the pushing means to engage each band during tear-off of each band from tubing, and the pushing means have a first pushing speed matching a peripheral speed of said continuously rotating tear-off rollers during a portion of each operating cycle when both the pushing means and the tear-off rollers are engaging the tubing for cooperation of said pushing means and said tear-off rollers in tearing off each band from the tubing; and during another portion of an operating cycle when the pushing means are engaging a band which has been torn off from the tubing and which has moved downstream along the mandrel beyond the tear-off rollers, the pushing means have a second pushing speed faster than said first pushing speed by at least 2.2 times for accelerating the band along the mandrel for ejecting an accelerated band onto an article during a dwell time of the article not exceeding 0.04 of a second.

20. Apparatus for banding articles with plastic bands as claimed in claim 16, wherein:

the tubing is label tubing and the plastic bands are label bands;

the feeding rollers have a predetermined peripheral speed during feeding of the opened label tubing downstream along the mandrel;

the continuously rotating tear-off rollers have a peripheral speed matching the predetermined peripheral speed of the feeding rollers;

the pushing means have a first peripheral speed matching the predetermined peripheral speed of the feeding rollers and also matching the peripheral speed of the tear-off rollers during a portion of an operation cycle when all three of the feeding rollers, the tear-off rollers and the pushing means are engaging the label tubing moving downstream along the mandrel; and during another portion of an operating cycle when the pushing means are engaging a label band which has been torn off from the label tubing and which has moved downstream along the mandrel beyond the tear-off rollers, the pushing means have a second peripheral speed faster than said first peripheral speed by at least 2.2 times for accelerating the label band along the mandrel for placing bands on articles at a rate of at least 500 articles per minute.

21. Apparatus for banding articles with plastic label bands as claimed in claim 20, wherein:

during said other portion of an operating cycle when the pushing means are engaging a label band which has been torn off from the label tubing and which has moved downstream along the mandrel beyond the tear-off rollers, the pushing means have a second peripheral speed faster than said first peripheral speed, said second peripheral speed being at least 1,000 feet per minute.

22. Apparatus for banding articles with plastic bands as claimed in claim 16, wherein:

the pushing means comprise a plurality of acceleration belts revolving around respective belt-drive pulleys and respective idler pulleys positioned downstream from the belt-drive pulleys and being near an ejection end of the mandrel;

each of said belts having lengths thereof travelling downstream adjacent to and parallel with the mandrel;

said downstream-travelling lengths of the belts being substantially symmetrically positioned around the mandrel; and a plurality of freely-turning companion rollers are mounted inside of the mandrel and are respectively positioned in opposed and axially aligned relationship with each of the belt-drive pulleys and with each of the idler pulleys.

23. Apparatus for banding articles with plastic label bands as claimed in claim 22, wherein:

said acceleration belts are substantially round as seen in cross section.

24. Apparatus for banding articles with plastic bands having film-like thickness, said banding apparatus comprising:

a floating mandrel;

feed means adjacent to the mandrel for feeding plastic tubing having film-like thickness downstream along the mandrel at a predetermined speed;

said plastic tubing having transverse perforations equispaced along the plastic tubing at predetermined spacing L;

said feed means comprising a plurality of continuously-rotating feed rollers having axes lying in a first transverse plane oriented transversely with respect to the mandrel;

sets of freely-rotatable upper and lower suspension rollers mounted inside of the mandrel;

the upper and lower suspension rollers in each set having their axes positioned above and below said first transverse plane;

a set of said suspension rollers being in opposed relation to each feed roller for suspending the floating mandrel;

said continuously-rotating feed rollers in cooperation with their respective sets of opposed suspension rollers serving dual functions of suspending the mandrel and also of continuously feeding the perforated plastic tubing downstream along the mandrel;

continuously-rotating tear-off rollers positioned downstream from said feed rollers for engaging the continuously-moving perforated plastic tubing adjacent to the mandrel;

said continuously-rotating tear-off rollers having a peripheral speed at least three times a peripheral speed of the continuously-rotating feed rollers for tearing successive plastic bands having film-like thickness off from the perforated plastic tubing and for accelerating successive torn-off plastic bands having a film-like thickness to a speed at least three times the speed at which said perforated plastic tubing is moving downstream along the mandrel;

said continuously-rotating tear-off rollers having axes lying in a second transverse plane oriented transversely with respect to the mandrel;

each of said continuously-rotating tear-off rollers having an opposed freely-rotatable companion roller mounted inside of the mandrel;

said companion rollers having their axes positioned in said second transverse plane for providing aligned rolling contact of said companion rollers and said tear-off rollers against inner and outer surfaces of each successive torn-off band having film-like thickness; and continuously-moving push-off means for pushing successive accelerated plastic bands having film-like thickness downstream along the mandrel and off from a downstream end of the mandrel toward successive articles to be banded with plastic bands having film-like thickness.

25. Apparatus for banding articles with plastic bands having film-like thickness as claimed in claim 24, wherein:

said continuously-moving push-off means comprise continuously-rotating toothed belt-drive pulleys positioned on opposite sides of the mandrel with push-off belts continuously revolving around said belt-drive pulleys;

said continuously revolving push-off belts have teeth engaging in positive drive relationship with the toothed belt-drive pulleys;

each of said continuously revolving push-off belts having a plurality of pusher elements secured to the belt equispaced along the belt projecting outwardly from the belt;

said continuously revolving push-off belts revolve around freely-rotating idler pulleys positioned near the downstream end of the floating mandrel;

the floating mandrel has channels extending downstream along the mandrel; and pusher elements simultaneously enter into respective channels for simultaneously pushing downstream against an upstream edge of each successive band of film-like thickness for pushing the bands downstream along the mandrel and for ejecting the bands from the downstream end of the floating mandrel toward successive articles to be banded with plastic bands having film-like thickness.

26. Apparatus as claimed in claim 25 for banding articles with plastic bands having film-like thickness, wherein:

outer ends of the pusher elements in swinging around axes of the idler pulleys are moving faster than the push-off belts imparting a final ejection acceleration kick to each band being ejected from the downstream end of the floating mandrel.

27. Banding apparatus as claimed in claim 26, wherein:

the idler pulleys have a radius larger than a radius R of the belt-drive pulleys for enlarging the radius of swing of tips of the pusher elements around the axes of the idler pulleys relative to their radius of swing around axes of the belt-drive pulleys for increasing a desired downstream final ejection acceleration kick being applied to the upstream edge of each band of film-like thickness while decreasing the component of motion outwardly against the upstream edge of each band.

28. Banding apparatus as claimed in claim 25, wherein:

at least one belt-drive pulley is mounted on a continuously rotating shaft on which is mounted a tear-off roller and the belt-drive pulley and tear-off roller are continuously rotating at the same rate of rotation.

29. Banding apparatus as claimed in claim 28, wherein:

the radius R of the belt drive pulley on each continuously rotating shaft is less than the radius of a rim of the tear-off roller on the shaft.

30. In a machine wherein articles are conveyed into and out of a banding station for banding the articles with plastic bands torn off from perforated plastic tubing, banding apparatus comprising:

continuously rotating feeding rollers for continuously pulling flattened plastic tubing downstream from a perforating station;

continuously rotating perforating means in said perforating station for perforating continuously moving flattened tubing with transverse perforations at predetermined intervals uniformly spaced at lengths L along the length of the flattened tubing;

a floating mandrel positioned downstream from said perforating station and sized to fit slidably inside of said tubing for opening the perforated tubing into a tubular configuration;

said continuously rotating feeding rollers being positioned adjacent the mandrel;

said continuously rotating feeding rollers for continuously pulling opened perforated tubing downstream around the mandrel;

said continuously rotating feeding rollers having their axes positioned in a first transverse plane extending transversely with respect to the floating mandrel;

sets of freely-rotatable suspension rollers mounted inside of the mandrel, the upper and lower suspension rollers in each set being positioned above and below said first transverse plane with a set of the suspension rollers being opposed to each feeding roller for suspending the mandrel;

said continuously rotating feeding rollers in cooperation with their respective sets of suspension rollers performing dual functions of continuously feeding the perforated plastic tubing downstream around the mandrel and also of suspending the mandrel;

continuously rotating tear-off rollers positioned a predetermined distance downstream from said continuously rotating feeding rollers and having their axes positioned in a second transverse plane extending transversely with respect to the floating mandrel;

said predetermined distance being suitable for imparting downstream-directed tear-off motion to the opened perforated tubing as the opened perforated tubing is continuously moving downstream around the mandrel;

said downstream-directed tear-off motion being at least two times faster than the opened perforated tubing is moving downstream around the floating mandrel for accelerating and tearing off successive lengths L of tubing at the transverse perforations for forming successive bands continuously moving downstream around said floating mandrel at higher speed than provided by said continuously rotating feeding rollers and for spacing successive bands from each other along the mandrel by a distance of at least L as they are moving downstream along the mandrel; and continuously moving push-off means positioned adjacent to the mandrel downstream from said continuously rotating tear-off rollers for pushing successive bands off from the mandrel toward articles in the banding station.

31. Banding apparatus as claimed in claim 30, wherein:

the continuously moving push-off means comprise a plurality of continuously revolving endless belts having portions travelling downstream from the continuously rotating tear-off rollers; and the portions of the continuously revolving endless belts are travelling downstream parallel with the mandrel.

32. Banding apparatus as claimed in claim 31, wherein:

each of the continuously revolving endless belts has a plurality of pusher elements thereon projecting outwardly from an outer surface of the belt;

the revolving endless bands are all driven in a positive driving relationship for keeping all belts revolving in synchronized relationship; and the pusher elements are equispaced spaced along each belt and the pusher elements on all synchronized belts are positioned in downstream alignment for pushing successive bands downstream along the floating mandrel and then off from the floating mandrel toward articles in the banding station by a plurality of pusher elements simultaneously pushing each successive band.

33. Banding apparatus as claimed in claim 32, wherein:

the floating mandrel has a plurality of channels therein extending downstream; and four pusher elements projecting outwardly from outer surfaces of four respective belts simultaneously enter into four respective channels for simultaneously engaging with trailing edges of successive bands for pushing successive bands downstream along the floating mandrel and then off from the floating mandrel toward articles in the banding station by four pusher elements simultaneously pushing each successive band.

34. Banding apparatus as claimed in claim 33, wherein:

at least one continuously revolving endless belt travels around an axis of each continuously rotating tear-off roller.

35. Banding apparatus as claimed in claim 34, wherein:

each of the continuously rotating tear-off rollers has a rim in rolling contact with the opened perforated tubing continuously moving downstream around the floating mandrel;

the rims of the continuously rotating tear-off rollers at their points of rolling contact with the opened perforated tubing are moving downstream at a second rate of speed at least two times faster than a first rate of speed at which the opened perforated tubing is moving downstream; and the downstream travelling portions of the continuously revolving endless belts are travelling downstream at a third rate of speed intermediate said first and second rates of speed.

36. Banding apparatus as claimed in claim 35, wherein:

the second rate of speed is more than about three times the first rate of speed.

37. Banding apparatus as claimed in claim 34, wherein:

two continuously revolving endless belts travel around the axis of each continuously rotating tear-off roller; and said tear-off roller is positioned between the two belts.

38. Banding apparatus as claimed in claim 34, wherein:

a continuously rotating toothed pulley wheel is positioned coaxially with each continuously rotating tear-off roller;

each toothed pulley wheel and the tear-off roller coaxial therewith are rotating at the same rate of rotation;

each tear-off roller has a rim in rolling contact with the opened perforated tubing continuously moving downstream around the floating mandrel;

the rims of the continuously rotating tear-off rollers are moving at a second rate of speed at least two times faster than a first speed at which the opened perforated tubing is moving downstream along the mandrel;

each toothed pulley wheel has a toothed endless belt running therearound in belt-driving relationship with the toothed pulley wheel; and each toothed pulley wheel is smaller in diameter than the tear-off roller coaxial therewith for moving four pusher elements simultaneously downstream at a third speed which is slower than the second speed at which the rim of each tear-off roller is moving and which is faster than the first speed at which the opened perforated tubing is moving downstream along the mandrel.

39. Banding apparatus as claimed in claim 38, wherein:

two continuously rotating toothed pulley wheels are positioned coaxially with each continuously rotating tear-off roller;

the two toothed pulley wheels and the tear-off roller coaxial therewith are rotating at the same rate of rotation;

the tear-off roller is located between the two toothed pulley wheels which are coaxial therewith;

each of the two pulley wheels has a toothed endless belt running therearound in positive driving relationship with the toothed pulley wheel; and each of the two pulley wheels is smaller in diameter than the tear-off roller coaxial therewith for moving four pusher elements simultaneously downstream at a slower speed than the speed of the rims of the tear-off rollers coaxial with the two respective pulley wheels.

40. Banding apparatus as claimed in claim 30, wherein:

said continuously rotating perforating means have revolving perforator blades revolving at a predetermined tip speed; and said continuously rotating feeding rollers are rotating with peripheral speed 0.03% to 0.5% faster than said tip speed for maintaining the perforated tubing under tension as it is being pulled downstream from the perforating means and onto the mandrel.

* * * * *